US005173735A

United States Patent [19]

Kusumoto

[11] Patent Number: 5,173,735

[45] Date of Patent: Dec. 22, 1992

[54] IMAGE FORMING APPARATUS WITH IMPROVED CLEANING OPERATION

[75] Inventor: Kenji Kusumoto, Toyokawa, Japan

[73] Assignee: Minolta Camera Kabushiki Kaisha, Osaka, Japan

[21] Appl. No.: 711,611

[22] Filed: Jun. 5, 1991

[30] Foreign Application Priority Data

Jun. 7, 1990 [JP] Japan ..... 2-149326
Jun. 7, 1990 [JP] Japan ..... 2-149328

[51] Int. Cl.[5] ..... G03G 15/14

[52] U.S. Cl. ..... 355/271; 15/1.51; 118/652; 355/208

[58] Field of Search ..... 355/208, 271, 296, 326, 355/327, 204, 299, 275; 118/652; 15/1.51

[56] References Cited

U.S. PATENT DOCUMENTS 4,862,224 8/1989 Ku ..... 355/271 X
4,984,026 1/1991 Nishise et al. ..... 355/271 X
4,989,048 1/1991 Arai et al. ..... 355/296 X
5,073,800 12/1991 Yamaguchi et al. ..... 355/296 X

*Primary Examiner*—A. T. Grimley
*Assistant Examiner*—P. J. Stanzione
*Attorney, Agent, or Firm*—Willian, Brinks, Olds, Hofer, Gilson & Lione

[57] ABSTRACT

An image forming apparatus according to the present invention includes a photoreceptor, an image forming unit for forming a toner image on the photoreceptor, an intermediate transfer medium to which the toner image formed on the photoreceptor is transferred at a transfer position and from which the transferred toner image is transferred to a sheet, a cleaning unit for removing toner on the intermediate transfer medium, and a controller for providing control for the sequence of activating a preliminary cleaning of the transfer belt for a predetermined time period, starting image formation after the preliminary cleaning is terminated, actuating a subsequent cleaning after termination of the transfer process, and then starting image formation in response to an image formation start signal output during the subsequent cleaning.

10 Claims, 30 Drawing Sheets

IMAGE FORMING APPARATUS WITH IMPROVED CLEANING OPERATION

BACKGROUND OF THE INVENTION

1. Field of the Invention

The present invention relates to a color copying apparatus for forming a color copy image by superimposing a toner image of each color.

2. Description of the Related Art

A conventional color copying apparatus forms a color copy image by superimposing toner images of the three primary colors of cyan (C), magenta (M), and yellow (Y).

An intermediate transfer method is known as the method of forming such a color copy image, comprising the steps of primary transferring in sequence a toner image of each color from a photoreceptor onto a transfer medium (toner image holding medium) rotating at a peripheral speed identical to that of the photoreceptor, to superimpose the toner images on the surface of the transfer medium, and secondary transferring each toner image at one time onto a recording paper (referred to as a "paper" hereinafter).

A color copying apparatus of the intermediate transfer method is provided with a cleaning unit for cleaning the surface of the transfer medium. The transfer medium is cleaned prior to and after the formation of the copy image using the cleaning unit.

The cleaning unit is implemented to be movable between an activating position (at the time of cleaning) and a withdraw position (at the time of copy image formation). This move is generally controlled by the ON/OFF of a solenoid.

During the cleaning prior to the formation of a copy image (referred to as "preliminary cleaning" hereinafter), the cleaning unit is brought to the activating position for at least one rotation of the transfer medium so that excess toner is removed from the whole circumference of the transfer medium. It is generally impossible to completely clean the entire surface of the transfer medium. Toner remains, i.e. wipe residual remains, at an area on the transfer medium confronting the cleaning unit in moving the cleaning unit to the withdraw position at the end of the cleaning.

The circumference of the transfer medium must be longer than the length of the sheet of the maximum size. It is also desirable that the circumference is as short as possible in order to increase the number of copy sheets per unit time.

Accordingly, the circumference of the transfer medium is defined taking into consideration the wipe residual, and is just a little bit longer than the length of the sheet of the maximum size.

The solenoid is driven at a constant timing to move the cleaning unit to the withdraw position.

In an electromagnetic activating unit such as a solenoid, the activating characteristic, i.e. the response speed with respect to a drive control signal, varies according to the temperature. In other words, the response speed becomes slower as the temperature rises due to repetition of ON/OFF.

There was a problem that the copy picture is deteriorated due to wipe residual of the toner images, since the timing of the cleaning unit moving to the withdraw position is delayed depending on temperature. Because a conventional apparatus drives the solenoid at a predetermined constant timing, such a problem was induced.

During preliminary cleaning and the cleaning after the formation of the image (referred to as "subsequent cleaning" hereinafter), the cleaning unit is positioned at the activating state at least for one rotation of the transfer medium, whereby excess toner is removed from the entire circumference of the transfer medium.

Subsequent cleaning is commenced after the secondary transfer. Upon the end of the subsequent cleaning of a predetermined time period, each component of the copying apparatus is returned to the standby state, i.e. the state before the commence of image formation.

The depression of a print key for commencing image formation is generally valid when secondary transfer ends in a color copying apparatus. In other words, the operator can specify the commence of the next image formation after the termination of the secondary transfer and during the subsequent cleaning.

When the print key is pressed during subsequent cleaning in a conventional copying apparatus, cleaning is continued until the elapse of a certain time period defined for subsequent cleaning, followed by a preliminary cleaning for the next image formation, which is also carried out for a predetermined time period.

With both the subsequent cleaning and the preliminary cleaning for the next image formation, the transfer medium will be cleaned continuously for over a time period that exceeds significantly the time of one rotation of the transfer medium, resulting in a problem that the start for the next image formation is delayed.

SUMMARY OF THE INVENTION

An object of the present invention is to prevent deterioration of a copy image in an image forming apparatus.

Another object of the present invention is to improve the accuracy of the termination timing of cleaning in an image forming apparatus.

A further object of the present invention is to quicken the commence of image formation operation in an image forming apparatus.

A still further object of the present invention is to carry out cleaning of a transfer medium efficiently in an image forming apparatus.

In view of the foregoing, an image forming apparatus according to an aspect of the present invention includes a holding medium for holding a toner image, cleaning means for cleaning toner from the holding medium, temperature detecting means for detecting the temperature within the image forming apparatus, and control means for controlling the activating timing of the cleaning means based on the detected temperature.

The image forming apparatus of the above described structure has the activating timing of cleaning controlled according to the temperature within the apparatus to allow cleaning of high accuracy for preventing deterioration of a copy image.

An image forming apparatus according to another aspect of the present invention includes a photoreceptor, an image forming means for forming a toner image on the photoreceptor, an intermediate transfer medium for receiving the toner image formed on the photoreceptor, transferring means for transferring the toner image on the intermediate transfer medium to a sheet, cleaning means for removing toner from the intermediate transfer medium, signal output means for providing an image formation start signal for commencing the image formation operation of the image forming means, first control means responsive to the provided image formation start signal for carrying out a preliminary cleaning of a predetermined time period and for commencing image formation by the image forming means after the preliminary cleaning has terminated, second control means for carrying out a subsequent cleaning of a predetermined time period after transfer process by the transferring means terminates, and third control means for commencing image formation by the image forming means after the subsequent cleaning of a predetermined time period ends, when the image formation start signal is provided by the image output means during subsequent cleaning.

The image forming apparatus of the above described structure has image formation initiated after the termination of the subsequent cleaning, if image formation is designated during subsequent cleaning, to quicken image formation operation.

The foregoing and other objects, features, aspects and advantages of the present invention will become more apparent from the following detailed description of the present invention when taken in conjunction with the accompahying drawings.

BRIEF DESCRIPTION OF THE DRAWINGS

FIGS. 5A–5K are flow charts specifically showing the content of the image formation process routine of FIG. 4.

DESCRIPTION OF THE PREFERRED EMBODIMENTS

The embodiments of the present invention will be explained with reference to the drawings.

Figure 1:
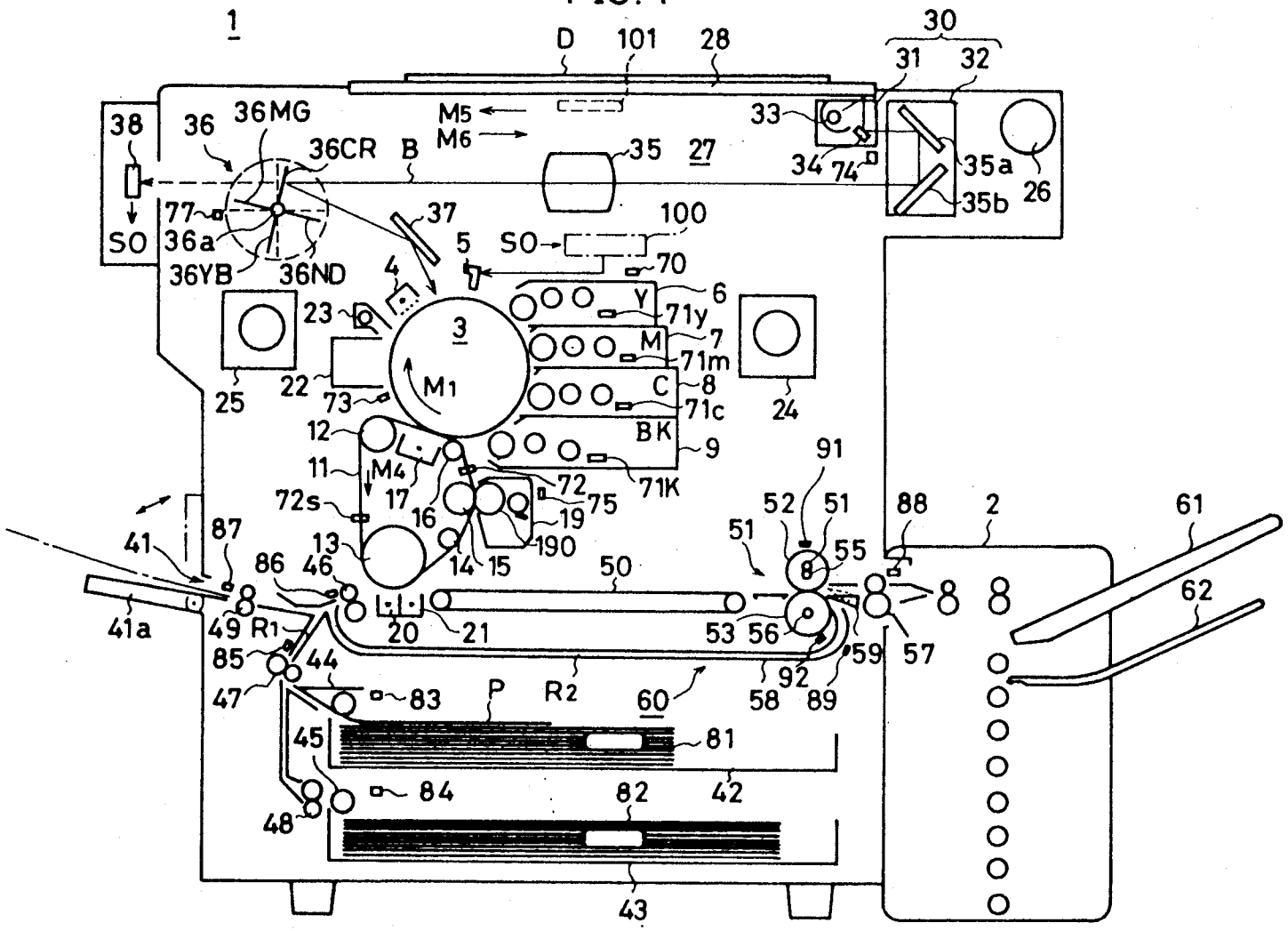
FIG. 1 is a front sectional view schematically showing a structure of copying apparatus according to an embodiment of the present invention.

FIG. 1 is a front sectional view schematically showing a structure of a copying apparatus 1.

A photoreceptor drum 3 rotatable in the clockwise direction (arrow Ml direction) is provided substantially leftwards and upwards of the center of copying apparatus 1. In the periphery of photoreceptor drum 3, a corona 10 charger 4, an editing eraser 5, developing units 6–9, a transfer belt 11 serving as an intermediate transfer medium, a cleaning unit 22, and a main eraser 23 are disposed.

The surface of photoreceptor drum 3 is formed of a photosensitive layer. The surface is charged in uniform by passing main eraser 23 and corona charger 4 to receive exposure for latent image formation from an optical system 27 described afterwards.

Editing eraser 5 comprises a LED array having a plurality of LEDs arranged in one row within a holder disposed along the axis direction of photoreceptor drum 3 to enable partial erasing of a latent image on photoreceptor drum 3. The illumination timing of each LED is controlled by an image processing portion 100.

Each of developing units 6, 7, 8 and 9 accommodate a developer having a toner of each color of yellow (Y), magenta (M), cyan (C) and black (BK), respectively, mixed with carrier for electrification due to friction. Each of developing units 6, 7, 8 and 9 are provided with toner concentration sensors (ATDC sensor) 71*y*, 71*m*, 71*c* and 71*k*, respectively, for controlling the concentration of the toner of each color.

Developing units 6–9 are not limited to the type that is fixedly disposed at the periphery of photoreceptor drum 3, and may be a type that are integrated and movable in the vertical direction. It also may be a type that selectively provides a toner of a different color to photoreceptor drum 3.

Transfer belt 11 is supported by a plurality of rollers 12–16 and is rotatable in a counter clockwise direction (in the direction of arrow M4) while always abutting against photoreceptor drum 3. Transfer belt 11 serves to temporarily hold the toner image developed by developing units 6–9 on photoreceptor drum 3 for transferring (secondary transfer) the same to a paper sheet P.

A transfer charger 17 is disposed inside of transfer belt 11 for primary transferring the toner image from photoreceptor drum 3 onto transfer belt 11. A transfer charger 20 for secondary transfer, a separation charger 21 for separating paper sheet P from transfer belt 11, and a belt cleaner 19 having a fur brush 119 for cleaning the outer surface of transfer belt 11 are disposed outside transfer belt 11.

Belt mark sensors 72 and 72*s* are fixedly disposed between rollers 15 and 16, and rollers 23 and 13, respectively, for detecting the position of transfer belt 11.

An original platen glass 28 is disposed at the top surface of copying apparatus 1. An original size detecting device 101 for detecting the size of original D is incorporated beneath and at the backside of original platen glass 28, moving so as not to disturb scanning.

Optical system 27 is disposed in the upper portion of copying apparatus 1. Optical system 27 is constituted by a scanner 30 beneath an original platen glass 28 reciprocatable in an arrow M5 direction (forward drive) and an arrow M6 direction (backward drive), a main lens 35 having its position adjusted according to the copying magnification, a mirror unit 36 for color separation exposure, a fixed mirror 37 for directing scanning beam B reflected from the mirror mounted on mirror unit 36 to an exposure point on photoreceptor 3, an image sensor 38 for photo receiving scanning beam B passing through the mirror of mirror unit 36, etc. An original D is scanned at the time of forward drive of scanner 30 to expose photoreceptor drum 3.

Scanner 30 is formed of a first slider 31 having an exposure lamp 33 and a mirror 34, and a second slider 32 having mirrors 35*a* and 35*b*. At the time of scanning original D, first slider 31 moves in the forward direction at a speed of v/n (n is the copy magnification) with respect to peripheral speed v of photoreceptor drum 3. Second slider 32 is driven by a scan motor (not shown) to move in the forward direction at a speed of v/2n. The termination of the backward drive of scanner 30, i.e., the return of scanner 30 to the home position, is detected by a scanner home switch 74 constituted by a photosensor.

Filter selecting device 36 has a half mirror 36 ND (the ratio of transmittance to reflection is 6 to 4) and three filter mirrors 36YB, 36MG, 36CR provided at right angles to each other radially from axis 36*a*. Axis 36*a* is rotated, whereby one of these mirrors is selectively switched and positioned. The mirrors and the filters are integrated by depositing blue (B), green (G) and red (R) color separating filters on the mirror surface of filter mirrors 36YG, 36MG, and 36CR to be used corresponding to the toner of colors Y, M and C, respectively.

In exposure scanning for forming an image, the selected mirror is positioned so that the reflecting surface thereof tilts approximately 10° against the perpendicular plane in the clockwise direction. This directs scanning beam B to the exposure point on photoreceptor drum 3. In the preliminary scan for reading the image on original D which is carried out prior to exposure scanning, half mirror 36ND is selected and positioned perpendicularly to be at right angles to the incident angle of scanning beam B to improve the MTF (image formation) of image sensor 38. Rotating position detecting sensor 77 functions to determine the home position of mirror unit 36. FIG. 1 indicates the state where filter mirror 36CR is selected and positioned at the image formation position.

Half mirror 36ND, filter mirrors 36YB, 36MG, 36CR are referred to as ND filters, B filter, G filter, R filter, respectively, according to the color separation characteristic.

An upper paper sheet cassette 42 and a lower paper sheet cassette 43 containing a plurality of paper sheets P are inserted at the lower portion of copying apparatus 1. A manual feed inlet 41 for manually feeding paper sheet P is provided at the left side of copying apparatus 1. Manual feed inlet 41 opens by opening a door 41*a*. Paper cassettes 42 and 43 and manual feed inlet 41 are selectively used in feeding paper.

Paper sheet cassettes 42 and 43 are provided with pickup rollers 44 and 45 for supplying paper sheets P one by one, and paper size sensors 81 and 82 for sensing the size of paper sheet P, and paper empty sensor 83 and 84 for sensing the shortage of paper sheet P. Manual feed inlet 41 is provided with a manual feed sensor 87 for sensing the insertion of paper sheet P.

Paper sheet P supplied from paper sheet cassette 42 or 43 is transported to a timing roller 46 by a paper feed roller 47 or paper feed rollers 48, 47, respectively. Paper sheet P inserted in manual feed inlet 41 is transported to timing roller 46 by manual paper feed roller 49.

A paper detecting sensor 85 for sensing whether there is a paper sheet P or not in a paper feed path R1 between paper feed roller 47 and timing roller 46 is provided in the vicinity of paper feed roller 47. A timing sensor 86 for sensing the leading edge of a passing paper sheet P is provided in the vicinity of timing roller 46.

The paper sheet P on standby is transported by the rotation of timing roller 46 at a timing complying with transfer belt 11, whereby a toner image is secondarily transferred from transfer belt 11 onto paper sheet P at the transfer position. Then, paper sheet P is forwarded to a fixing unit 51 by a transport belt 50 having a linear distance corresponding to a paper sheet of an A4 size.

Fixing unit 51 is constituted by an upper roller 52 having heater lamps 54 and 55, and a lower roller 53 having a heater lamp 56. The toner image is fused to be fixed on paper sheet P. Temperature sensors 91 and 92 formed of a thermistor are provided in the vicinity of rollers 52 and 53, respectively.

Paper sheet P having a desired copy image formed by fixing the toner image is forwarded to a sorter 2 by a discharge roller 57 disposed in the vicinity of a discharge sensor 88 to be provided to a receptor tray 61 of sorter 2 or a vane (shelf) 62 for sorting.

Copying apparatus 1 of the present invention is provided with a return unit 60 for refixation used at the time of image formation at the OHP mode which forms a copy image for an overhead project. Return unit 60 conveys sheet P passing through fixing unit 51 again to the inlet of fixing unit 51 (transport belt 50 side). Return unit 60 is constituted by a transport mechanism 58 having a return path R2 from the discharge side (outlet) of fixing unit 51 to the above described timing roller 46, and a switching claw for switching the transport direction of sheet P discharged from fixing unit 51 to the discharge roller 57 side or the return path R2 side. Switching claw 59 is driven by a solenoid not shown. A return paper detecting sensor 89 is disposed in the proximity of switching claw 59 for detecting the presence of sheet P in return path R2.

Main motor 24 functions to drive relevant components related to feeding and transport of paper sheet P, and PC motor 25 functions to drive photoreceptor drum 3 and transfer belt, in FIG. 1. Cooling fan 26 cools the interior of the copying apparatus.

Copying apparatus 1 of the above described structure can form a monocolor copy image of a single toner color of the aforementioned Y, M, C and BK; a composite monocolor copy image of R (Y and M), G (Y and C), and B (M and C) obtained by superimposing the toner image of two colors out of the three primary colors of Y, M, and C; and a color (full color) copy image obtained by superimposing the toner images of the three primary colors.

To form a monocolor copy image of a single toner color (monocolor mode), original D is exposed by scanning using half mirror 36ND to develop a latent image formed on photoreceptor drum 3 by one of developing units 6–9 according to the specified color, whereby a toner image is transferred onto transfer belt 11.

To form a composite monocolor copy image, original D is exposed by scanning two times with half mirror 36ND to superimpose toner images of two colors on transfer belt 11.

To form a color copy image (full color mode), toners of Y, M and C are subsequently used. More specifically, exposure scanning is carried out for a total of three times for the same original D with selective switching of each filters of B, G, and R and developing units 6–8 for each scanning. A color-separated latent image of original D is formed and developed. The respective toner images are subsequently transferred onto transfer belt 11 to superimpose toner images of each color on transfer belt 11.

It is necessary to transfer each toner image onto the same position on transfer belt 11 in superimposing the toner images (referred to as "multitransfer" hereinafter). In copying apparatus 1 of the present embodiment, the signal from belt mark sensors 72 or 72*s* first detecting the belt mark provided at one position on transfer belt 11 is regarded as belt mark signal S10. According to the generation timing of this belt mark signal S10, the commence timing of the move of scanner 30, i.e. the commence timing of latent image formation on photoreceptor drum 3, is controlled.

Figure 2:
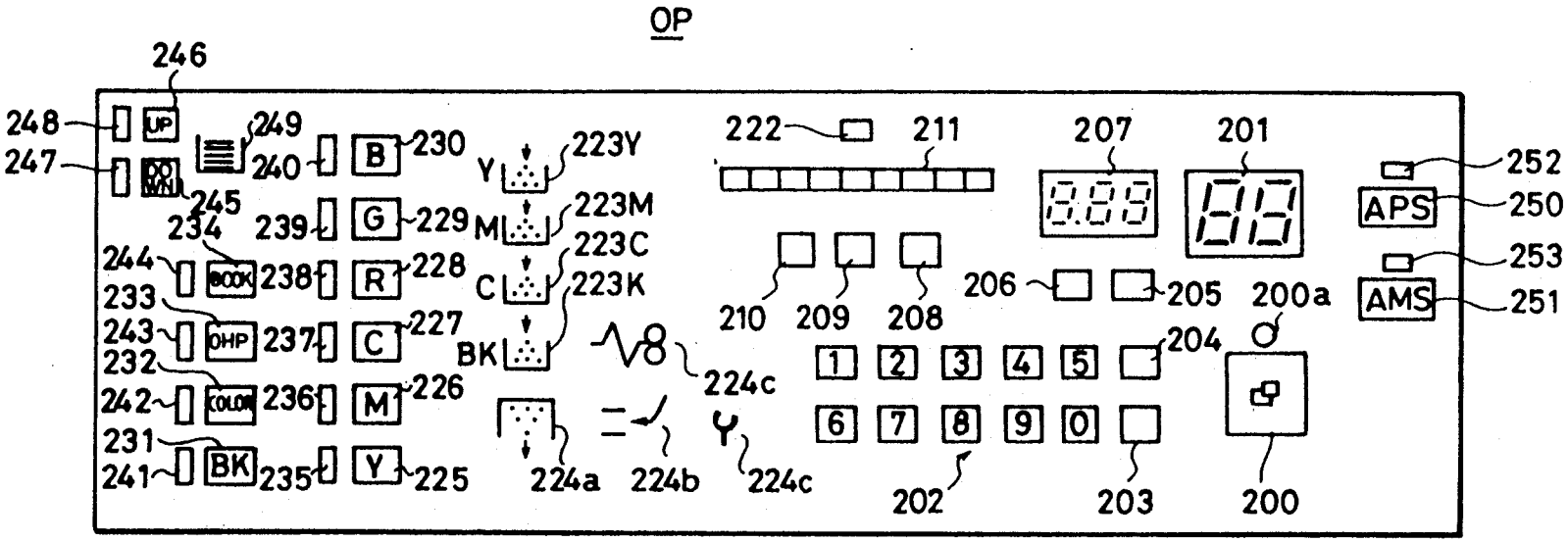
FIG. 2 is a plan view of an operation panel provided on the top surface of the copying apparatus of FIG. 1.

FIG. 2 is a plan view of an operation panel provided on the top surface of copying apparatus 1.

At the right side of operation panel OP are provided a key 250 for specifying automatic paper selecting mode and a display LED 252 thereof, a key 251 for specifying automatic magnification selecting mode and a display LED 253 thereof, a print key 200 for starting the copy operation, a LED 200a that emits green illumination when copy is allowed, a ten key 202 for specifying copy conditions such as the number of copies, a 7 segment LED 201 for displaying the number of copies, a clear stop key 203, an interrupt key 204, magnification up and magnification down keys 205 and 206 for specifying the copy magnification, a 7 segment LED 207 of three figures for displaying the copy magnification, up key and down key 210 and 208 for specifying manually the concentration of the copy image in steps, a LED 211 for displaying the concentration level of the copy image, an automatic concentration setting key 209, an automatic concentration display LED 222, etc. These are used in the normal copy operation.

At the left side of operation panel OP are provided LEDs 223Y, 223M, 223C, 223K for displaying the shortage of Y, M, C, BK color toners, a LED 224*a* for displaying that the container of disposal toner is full, an interrupt display LED 224*b*, a paper sheet P jam display LED 224*c*, a trouble display LED 224*d*, color keys 225–231 corresponding to the respective color (Y, M, C, R, G, B, BK) for specifying the color of the monocolor copy image, a full color key 232 for specifying color copy, an OHP key 233 for specifying the OHP mode, a book key 234 used for copying the left and right pages of a double spread original such as a book, display LEDs 235–244 for each of keys 225–234, respectively, sheet selecting keys 245, 246, LEDs 247 and 248 for displaying the selected paper sheet cassettes 42 and 43, and a paper empty LED 249 for displaying the shortage of paper sheet P in the selected paper sheet cassettes 42 and 43.

Figure 3:
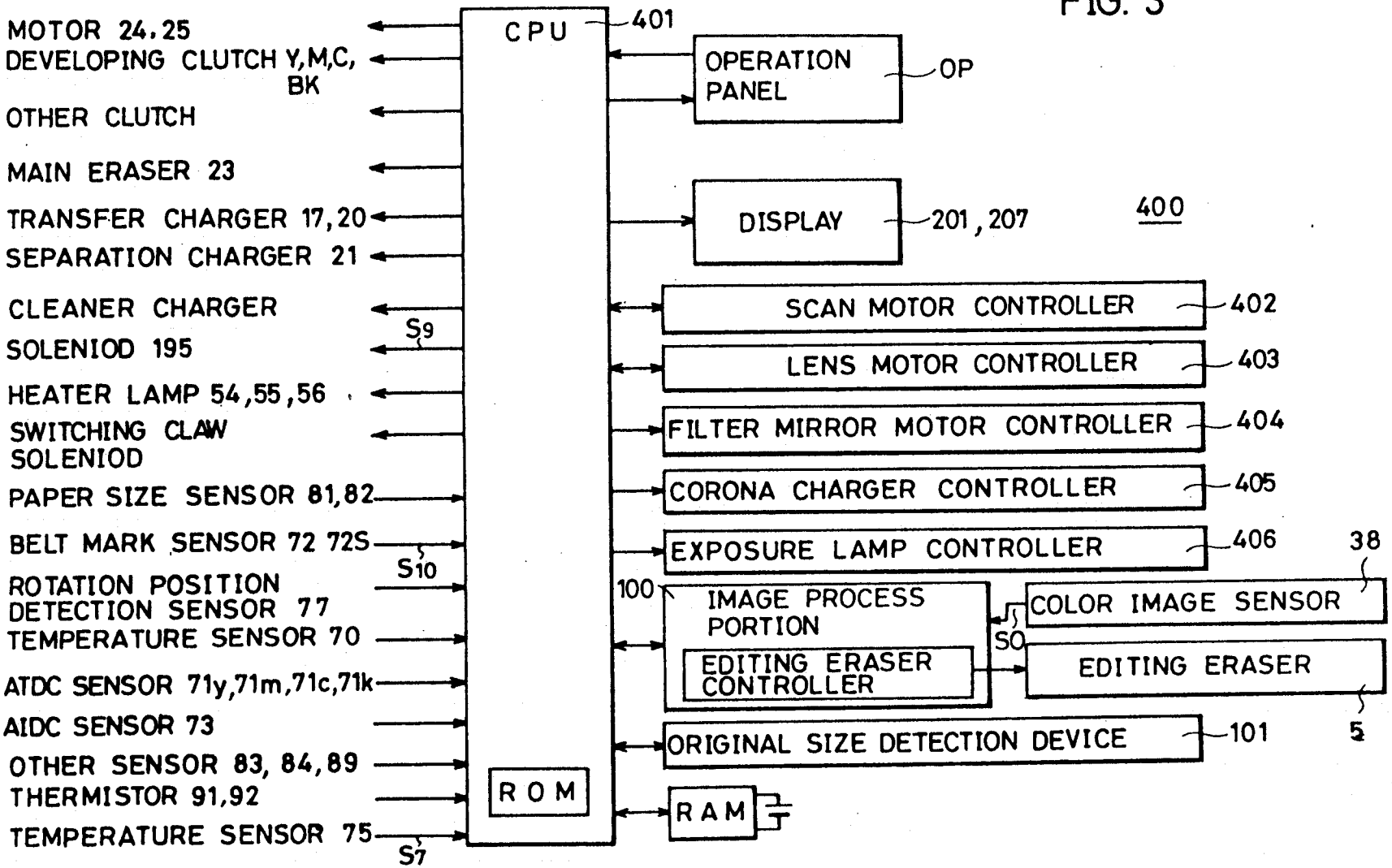
FIG. 3 is a block diagram of a structure of a control portion of the copying apparatus of FIG. 1.

FIG. 3 is a block diagram of a control portion 400 of copying apparatus 1.

Control portion 400 is mainly based on a CPU (central processing unit) 401 that controls the entire operation of copying apparatus 1, comprising a scan motor controller 402 for controlling the drive of scanner 30, a lens motor controller 403 for controlling the move of main lens 35 according to the copy magnification, a filter mirror motor controller 404 for controlling the drive of filter selecting device 36, a corona charger controller 405, and an exposure lamp controller 406.

Operation panel OP for specifying various operations and display portions 201 and 207 for displaying various numeral information are connected to CPU 401.

Furthermore, an image processing portion 100 for carrying out signal process of photoelectric converting signal S0 of color image sensor 38, and an original size detecting unit 101 for making determination of the size and the positioned direction (lengthwise or breadthwise) by combination of each output of a plurality of reflective type photosensors using a well known detecting method, are connected to CPU 401.

The analogue input port and the digital input port of CPU 401 is supplied with the output signal of a sensor disposed in each component of copying apparatus 1. According to the signal from each sensor and switch matrix 451, and data from image processing portion 100 and original size detecting unit 101, the ON/OFF or operation level of each component of motors 24 and 25 connected to the output port, various clutches such as a developing clutch, and each charger are controlled.

CPU 401 has a non-volatile memory incorporated for storing management data such as the accumulated number of copies and the number of jam occurrence.

Figure 9:
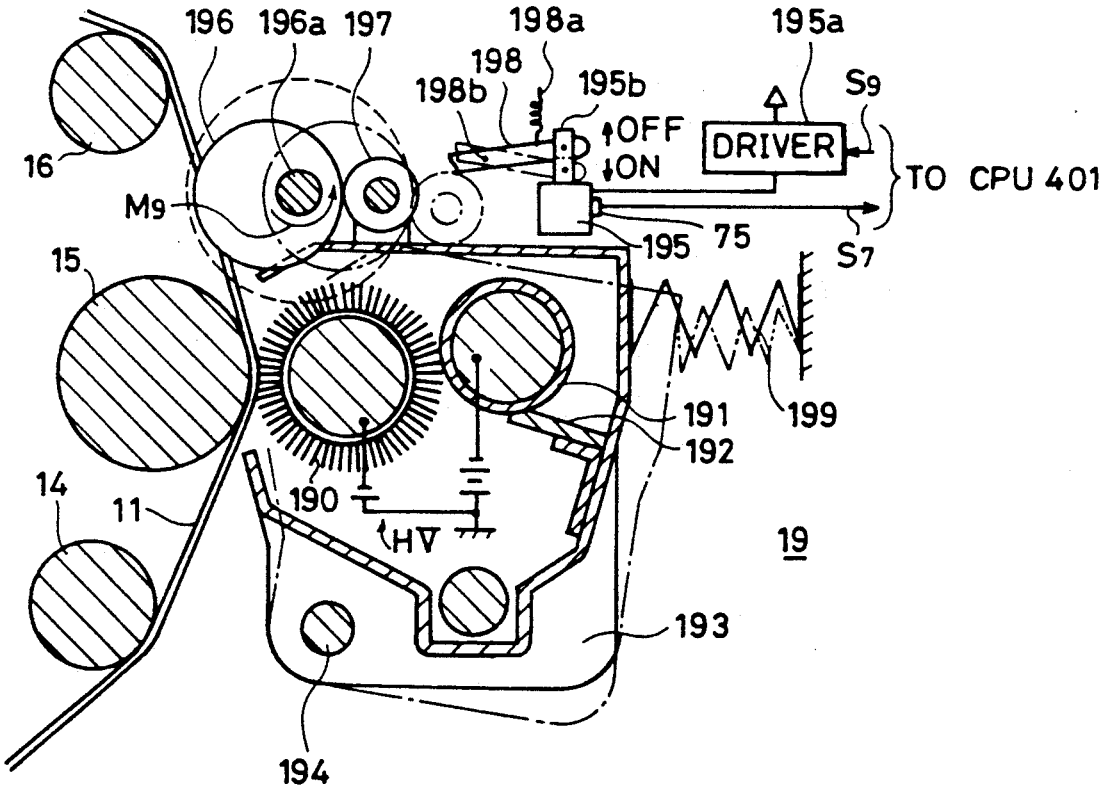
FIG. 9 is a sectional view specifically showing a structure of the belt cleaner of FIG. 1.

FIG. 9 is a front sectional diagram of a belt cleaner 19.

Belt cleaner 19 comprises a cylindrical fur brush 190 disposed to confront roller 15 supporting transfer belt 11, collecting roller 191 for collecting the swept up toner from transfer belt 11 by fur brush 190, a blade 192 for removing toner attached to the surface of collecting roller 191, and a housing support 193 for supporting these members. Belt cleaner 19 is implemented to be movable by being rotatable around spindle 194 between an activating position where fur brush 190 is abutted against transfer belt 11, and a withdraw position where there is a predetermined distance between fur brush 190 and transfer belt 11.

FIG. 9 shows belt cleaner 19 in the activating position. The withdrawal position is indicated by the chain dotted line in the figure.

The mechanism to move belt cleaner 19 is implemented with a disc-like eccentric cam 196 mounted to rotation axis 196*a*, an anchor lever 198 for stopping the rotation of rotation axis 196*a* every 180°, a solenoid 195 for rotating anchor lever 198, a spring 199 for energizing belt cleaner 19 to be always pressed to the transfer belt 11 side, and a mechanical clutch (not shown) for energizing rotation axis 196*a* to always rotate in the arrow M9 direction.

Anchor lever 198 is provided with a blocking claw and a blocking head not shown at the tip. The rotation of anchor lever 198 causes rotation axis 196*a* to rotate so that a projection (not shown) formed in rotation axis 196*a* abuts alternately the blocking claw or the blocking head, whereby rotation axis 196*a* is positioned every 180°.

Solenoid 195 is driven ON/OFF by a driver 195*a* controlled by a drive control signal S9 provided from a CPU401 described afterwards.

When solenoid 195 is off, belt cleaner 19 is at the activating state. At this time, eccentric cam 196 is at a state as shown in the figure, whereby the contact between roller 197 fixed rotatably in the upper portion of housing support 193 and eccentric cam 196 positions belt cleaner 19 so that fur brush 190 comes into appropriate pressure-contact with transfer belt 11.

When solenoid 195 is turned on by the application of drive control signal S9 to driver 195*a* and a rod 195*b* moves downwards opposing the energization of spring 198*a*, anchor lever 198 rotates around spindle 198*b*, whereby the rotating blocked state of rotation axis 196*a* is switched by a blocking claw or a blocking head not shown. This causes rotation axis 196*a* to make a half-turn, whereby eccentric cam 196 presses roller 197 opposing the energization of spring 199. This moves belt cleaner 19 to the withdrawal position.

To remove toner remaining on the surface of transfer belt 11, i.e. to clean transfer belt 11, belt cleaner 19 is moved to the activating position to make fur brush 190 contact with transfer belt 11. Voltage HV (cleaner bias HV) for charging is applied to fur brush 190 and collecting roller 191 from a cleaner high voltage power supply 405 to rotate fur brush 190 and collecting roller 191. Toner on transfer belt 11 is swept up and absorbed electrostatically by fur brush 190 in the charged state. Because cleaner bias HV is set so that the charge amount of collecting roller 191 is greater than that of fur brush 190, toner attached to fur brush 190 moves to collecting roller 191 having a great absorption. The toner absorbed by collecting roller 191 is swept up from collecting roller 191 by blade 192 to be gathered in a disposal toner bottle (not shown).

Solenoid 195 is provided with a temperature sensor 75 that detects the temperature. The output signal S7 from the temperature sensor is provided to CPU 401.

In the following description, the transfer of belt cleaner 19 to the activating position by turning off solenoid 195 is called "the pressure-contact of fur brush 190", and the transfer of belt cleaner 19 to the withdraw position by turning on solenoid 195 is called "the withdrawal of fur brush 190". The application of cleaner bias HV to fur brush 190 and collecting roller 191 is called "the ON of cleaner bias HV", and to stop the application of cleaner bias HV is called "the OFF of cleaner bias HV".

The operation of copying apparatus 1 will be explained with reference to the flow charts.

Figure 4:
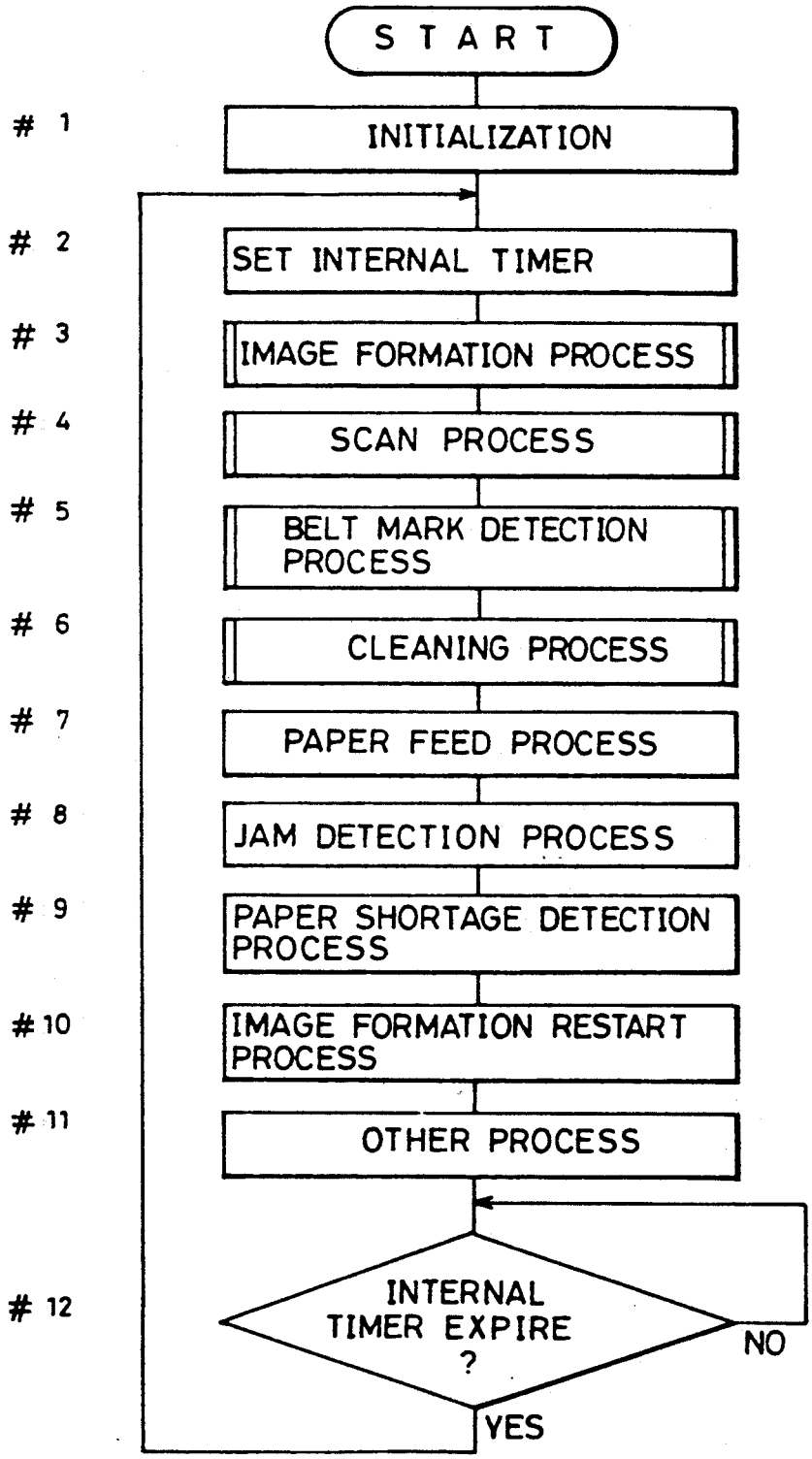
FIG. 4 is a flow chart of a main routine by a CPU 401 of FIG. 3.
Figure 5A:
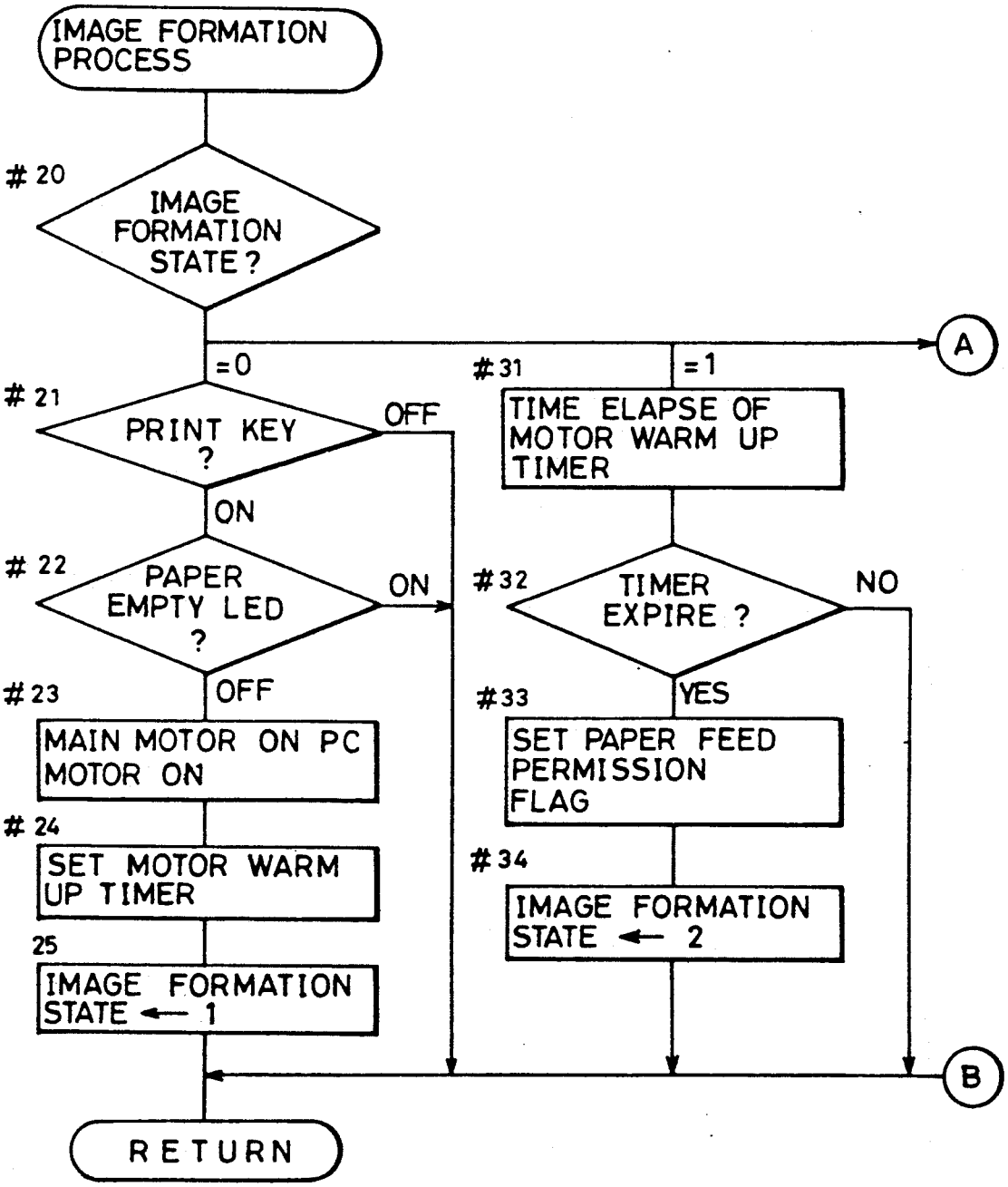
Figure 5B:
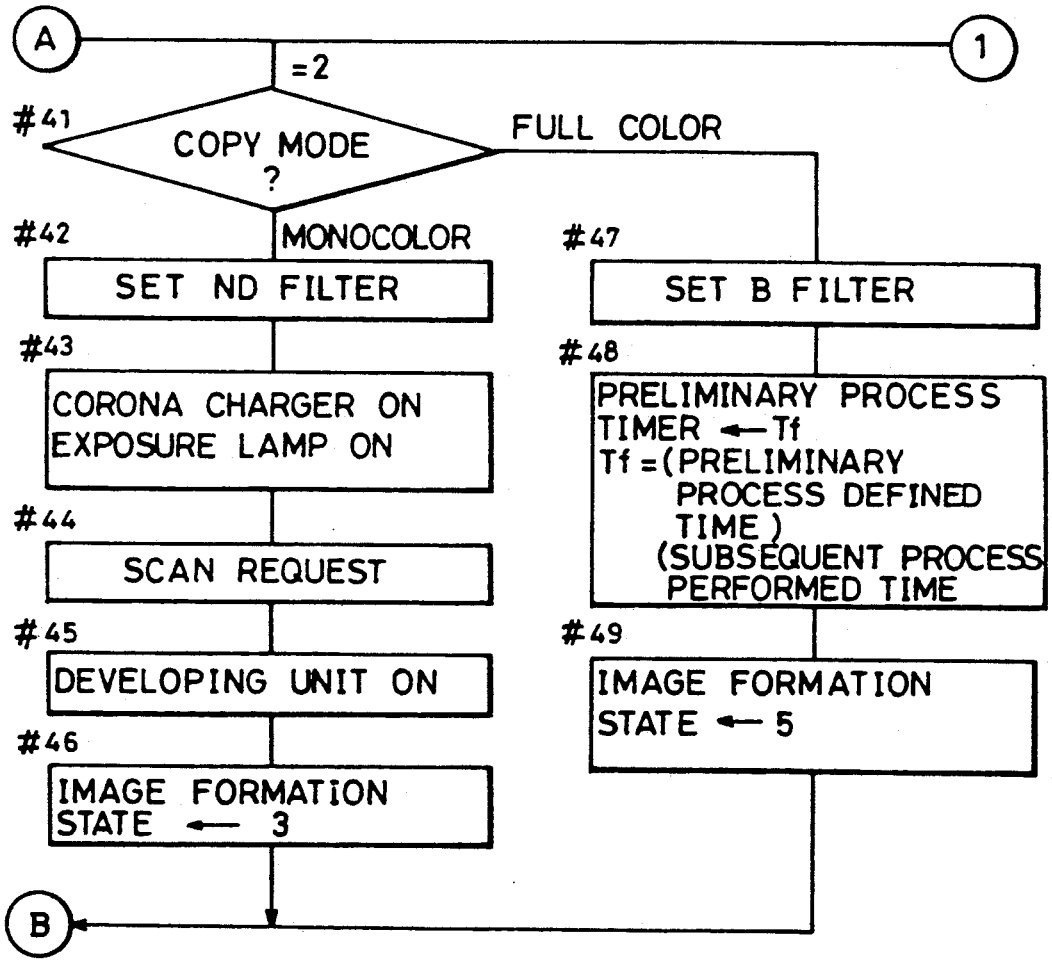
Figure 5C:
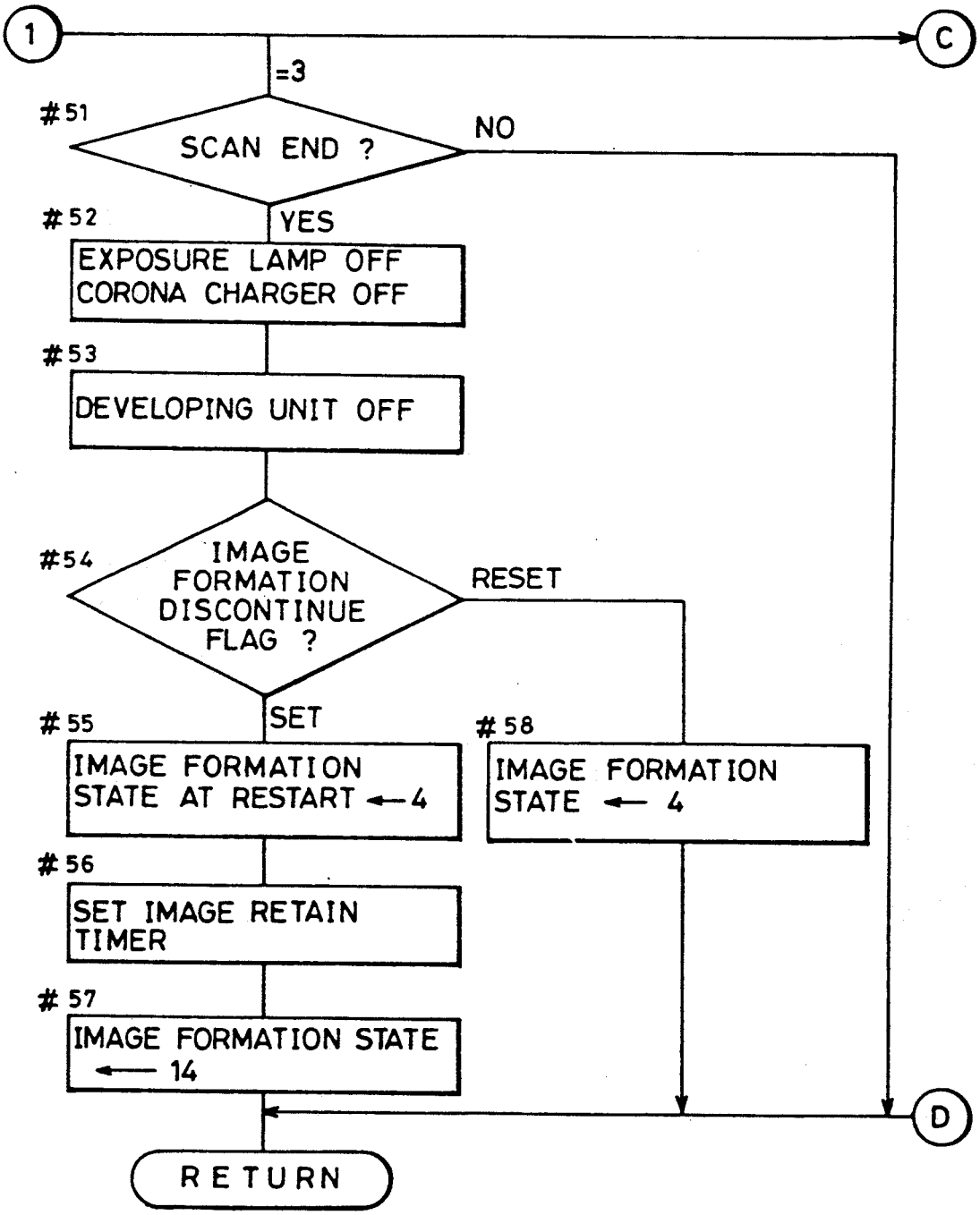
Figure 5D:
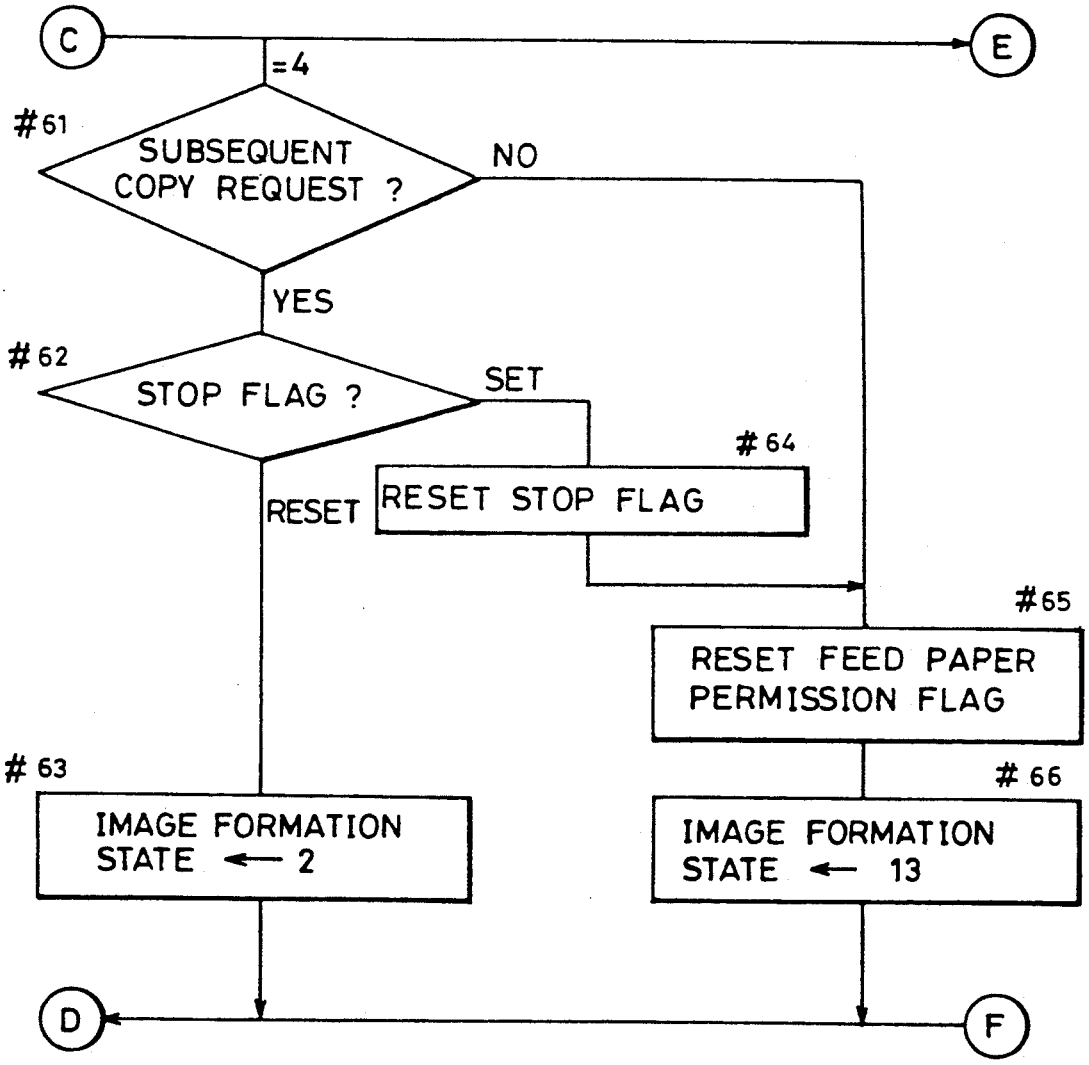
Figure 5E:
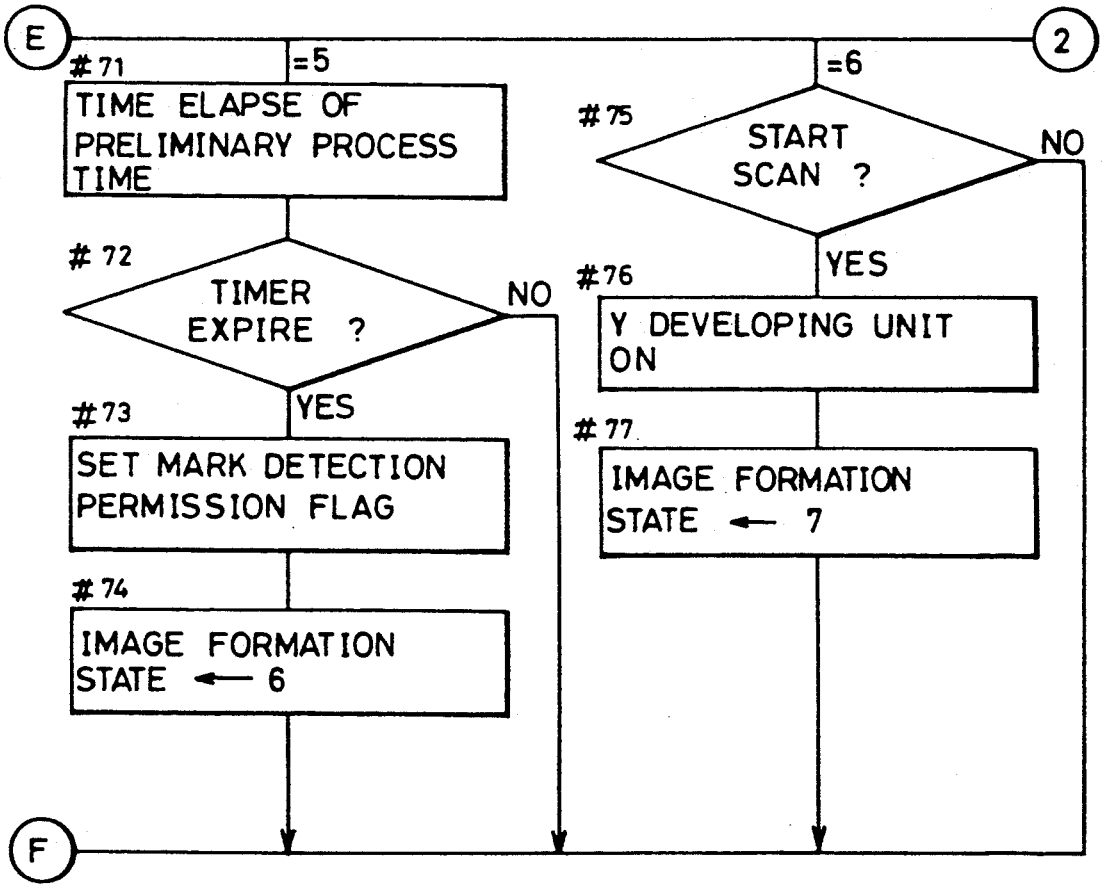
Figure 5F:
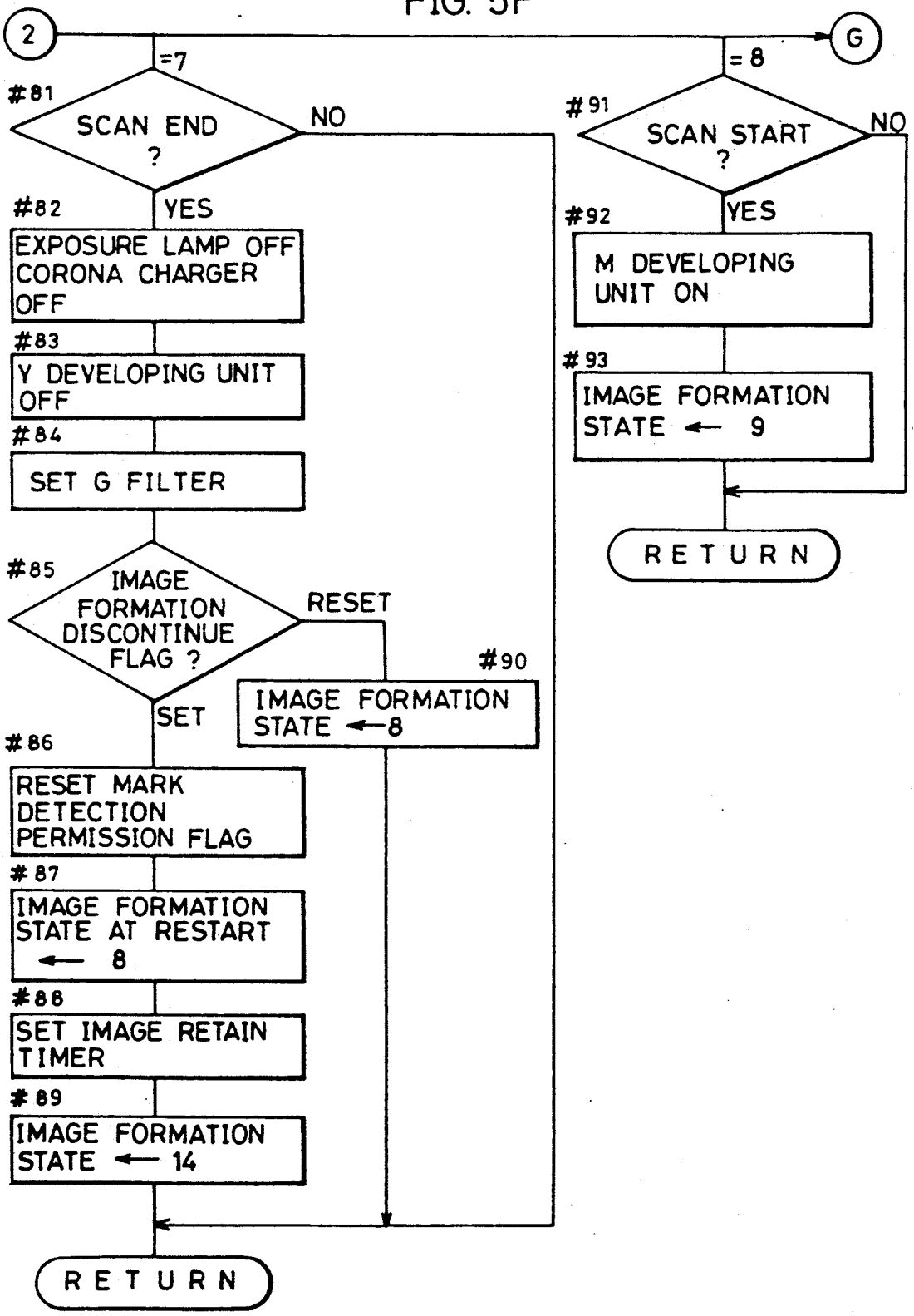
Figure 5G:
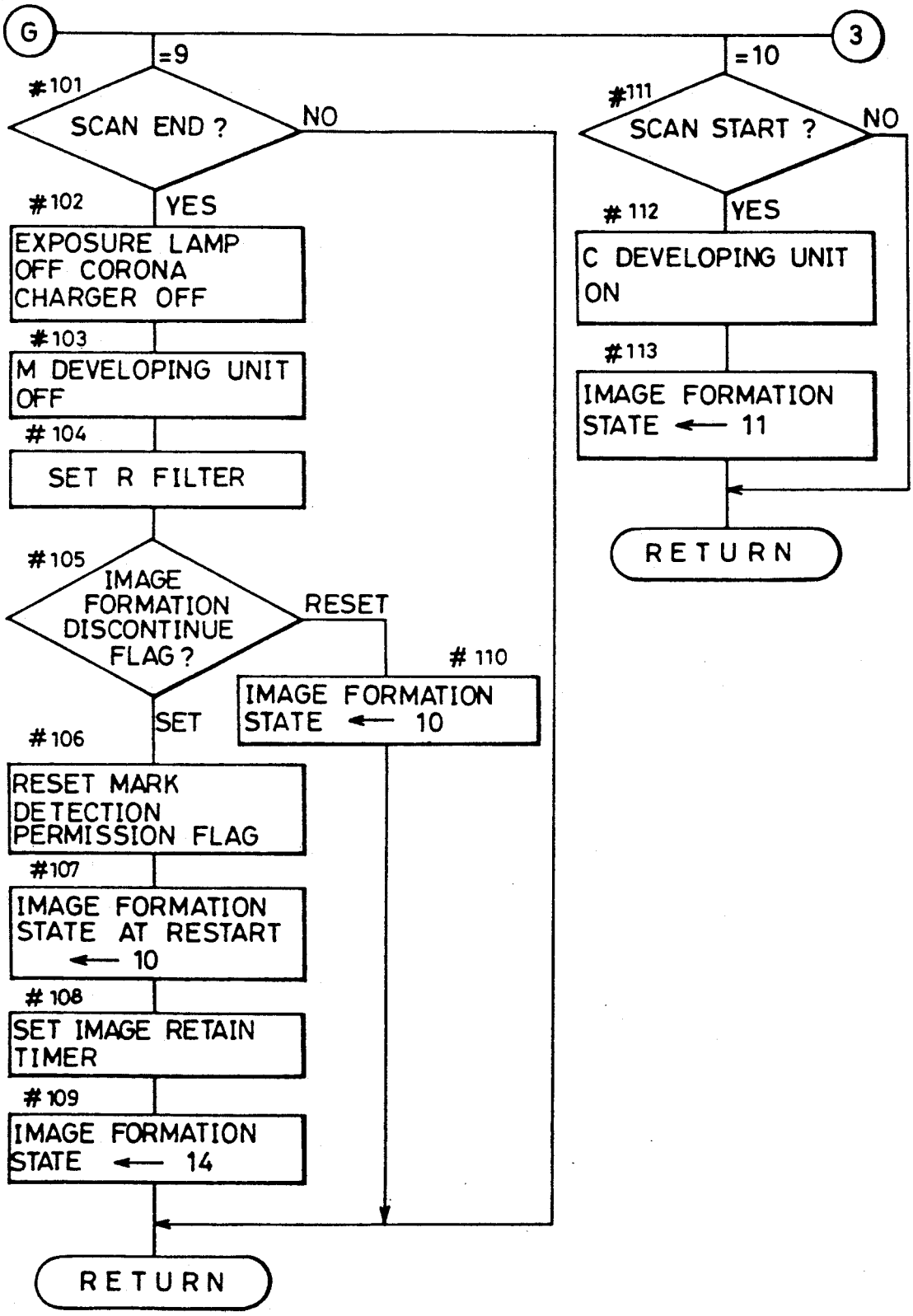
Figure 5H:
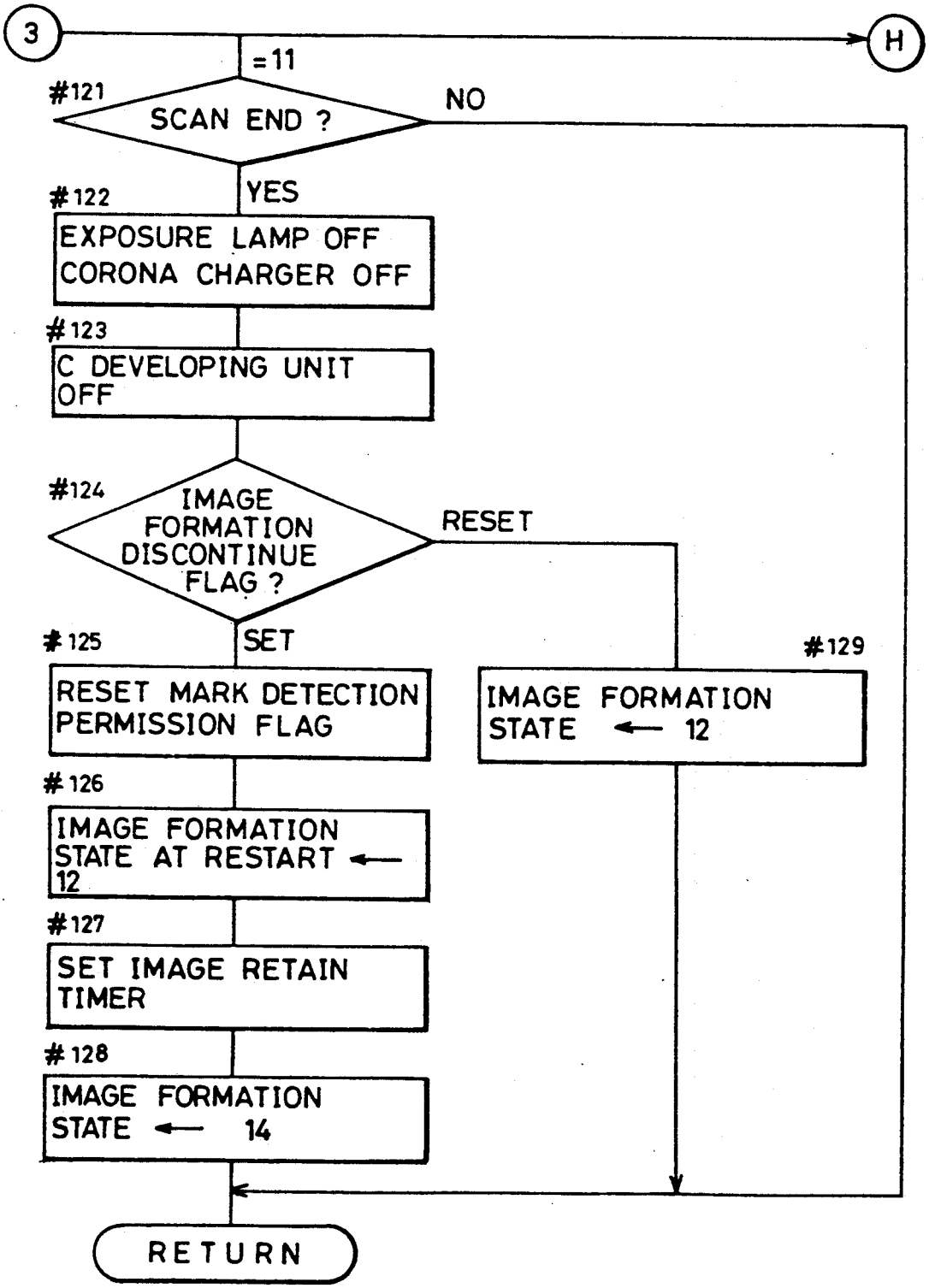
Figure 51:
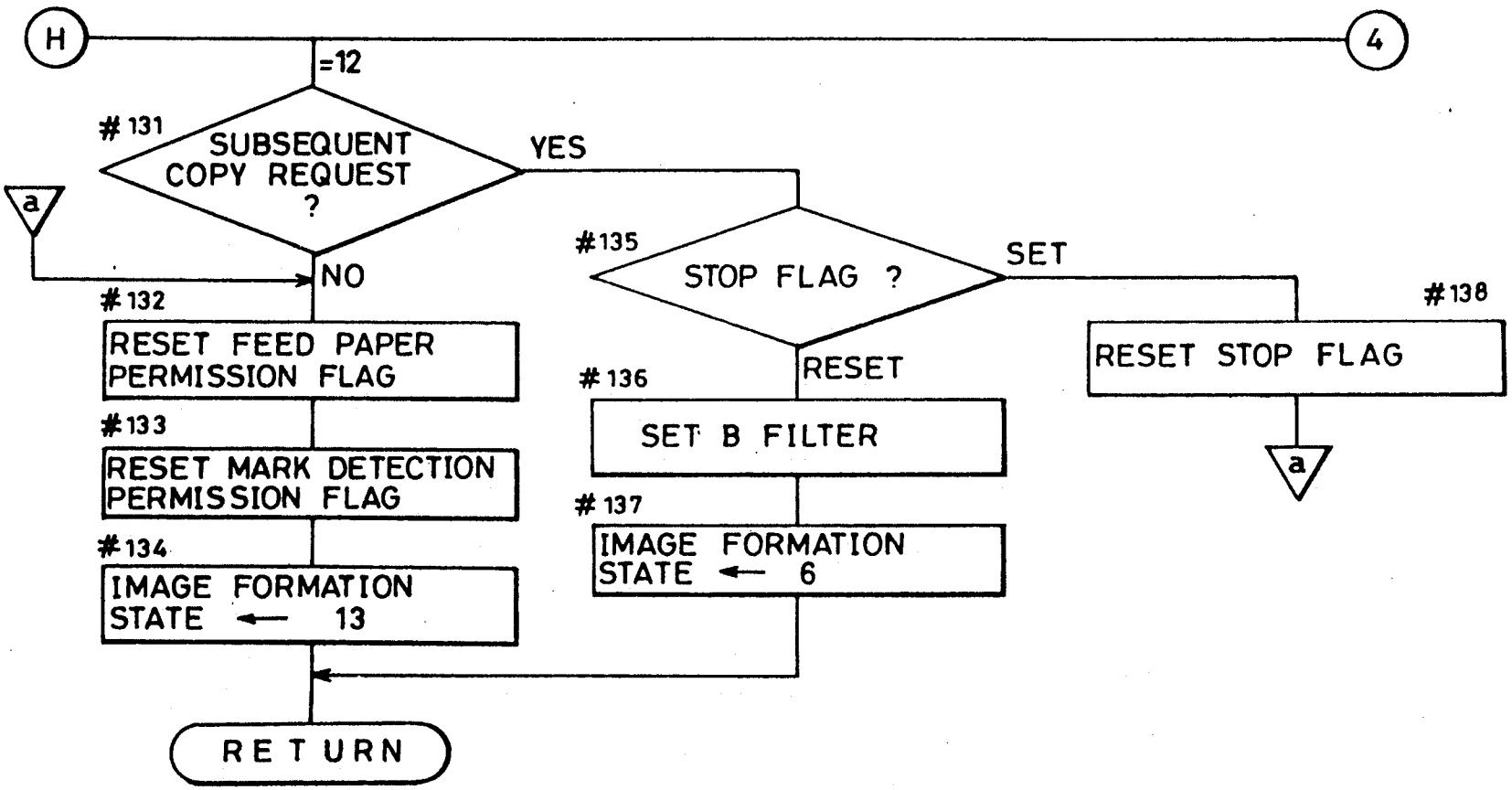
Figure 5J:
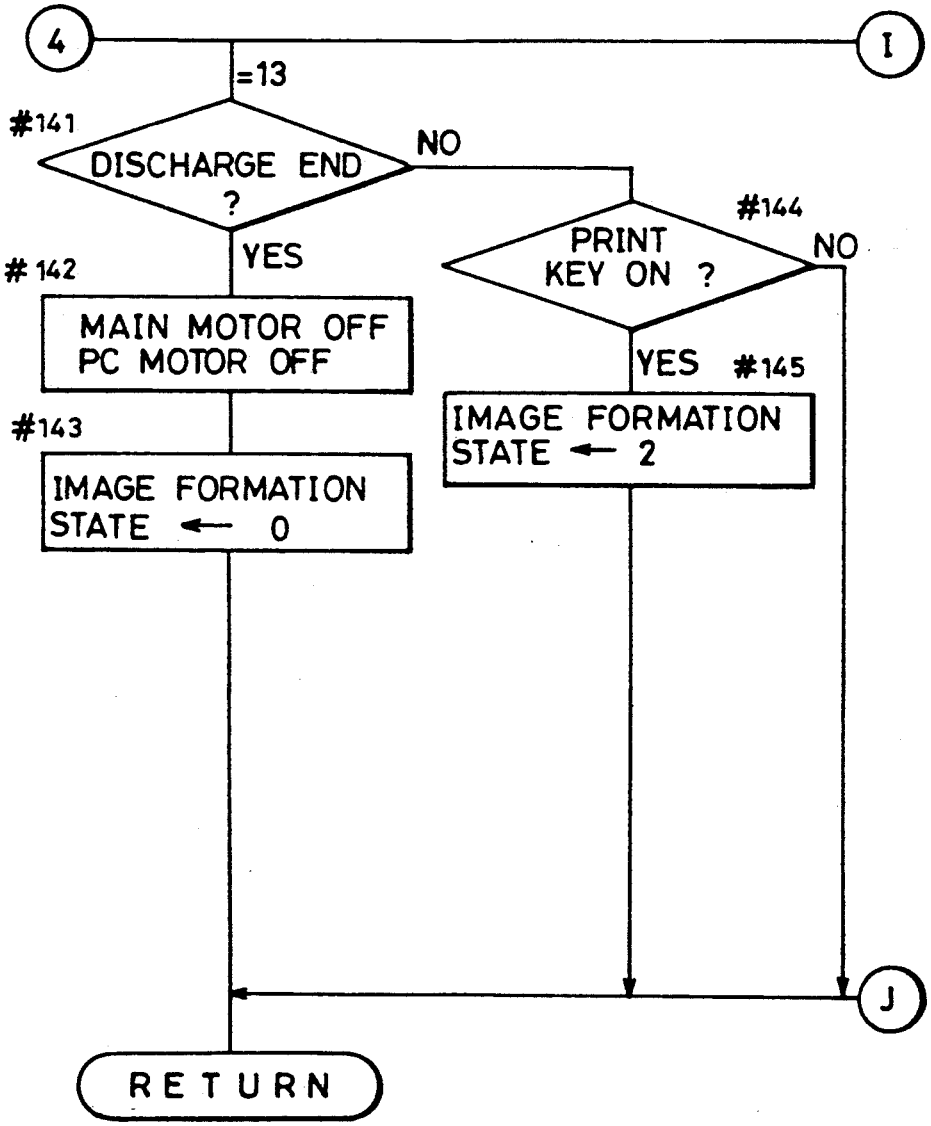
Figure 5K:
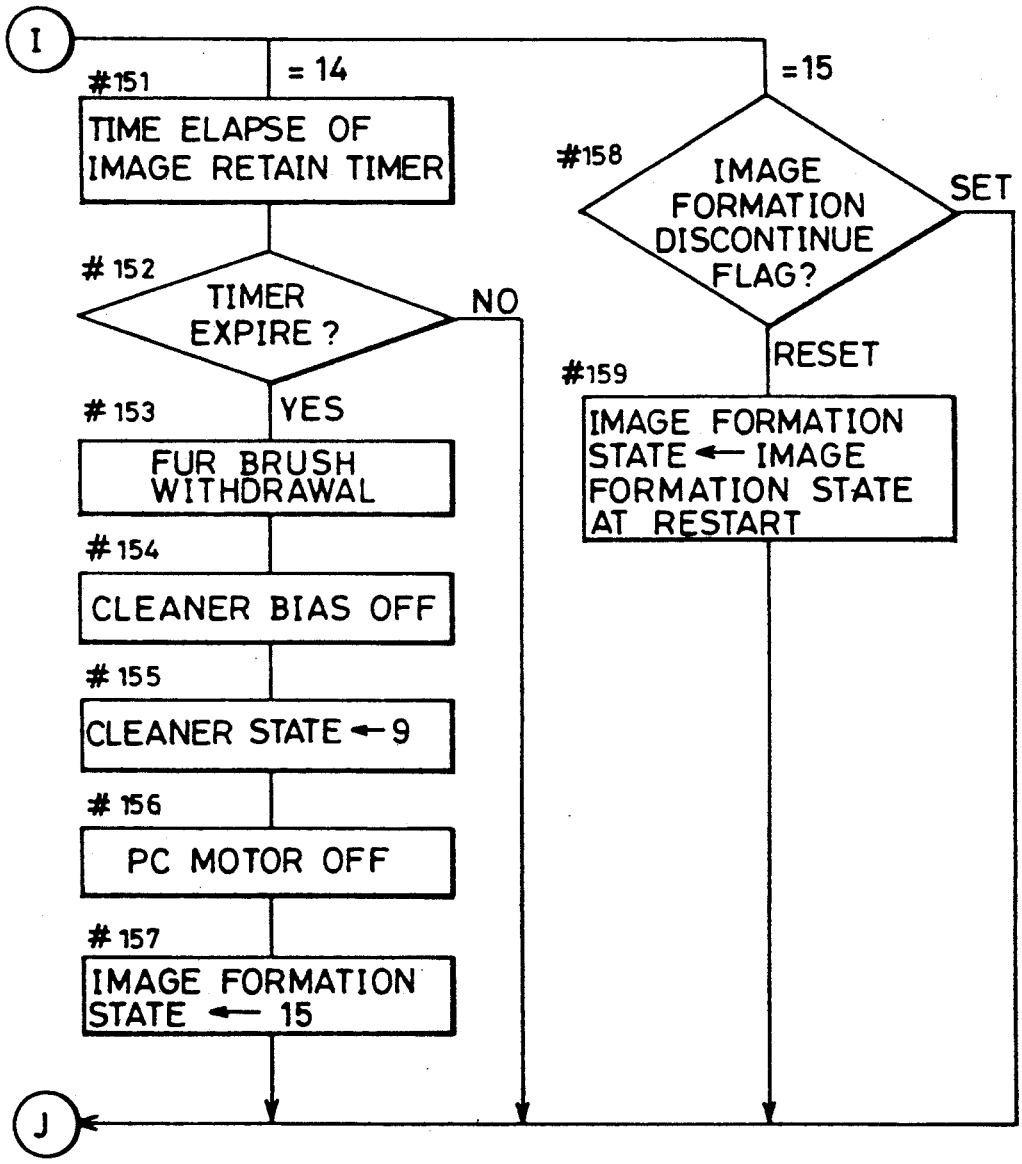

FIG. 4 is a main flow chart schematically showing the operation of CPU 401.

When power is supplied and the program starts, the register and the peripheral interfaces are initialized. The internal timer for defining the duration of one routine of CPU 401 is set (steps #1 and #2).

Then, an image formation process relating to electrophotograpy process, a scan process for scanning original D, a belt mark detecting process for determining the timing of multitransfer, a cleaning process for cleaning transfer belt 11, a paper feed process for controlling feeding and transport of paper sheet P, a jam detecting process corresponding to paper sheet P jam (paper jamming), a paper shortage detecting process for detecting the presence of paper sheet P in paper sheet cassettes 42 and 43, an image formation restart process for starting again the image formation process discontinued by the occurrence of paper sheet P shortage or jam, and other process such as receiving a signal from operation panel OP and from the sensors of various components, are carried out sequentially (steps #3–#11).

After all these process are carried out, waiting is conducted for the internal timer to expire (step #12) to return to step #2. This maintains the duration of one routine to be constant, where each process of steps #2–#12 are repeated as long as power is supplied.

In copying apparatus 1 of the present embodiment, solenoid 195 of belt cleaner 19 is provided with a temperature sensor 75 for detecting temperature, as described before.

During the cleaning process where the drive of belt cleaner 19 is controlled, CPU 401 corrects the timing of the withdraw of fur brush 190, i.e. the output timing of drive control signal S9, according to output signal S7 of temperature sensor 75. For example, when the temperature of solenoid 195 is higher than a predetermined temperature, a time period shorter than a predetermined standard time period is set for the duration of the withdraw timer to provide drive control signal S9 simultaneously at the expiration of the withdraw timer. This will avoid the overlap of the toner image with the wipe residual. Each process of FIG. 4 (steps #3–#10) will be explained in order.

FIGS. 5A–5K are flow charts of the image formation process of FIG. 4.

In this routine, a check is first made of the image formation state indicated by a count value of the state counter (step #20). The following process are carried out according to each state.

The state shows "0" at the initialization state right after power is supplied and at the standby state after the termination of copy operation.

At state "0", waiting is conducted for the depression (ON) of print key 200. The ON of print key 200 is invalid when paper empty LED 249 is lit (steps #21 and #22).

If there is paper sheet P in paper sheet cassettes 42 or 43 specified by paper sheets selecting keys 245 and 246, main motor 24 and PC motor 25 are turned on responsive to the ON of print key 200 to start the rotation drive of each component such as photoreceptor drum 3. A motor warm up timer is set to a predetermined timer value to attain stabilized rotation of motors 24 and 25 (steps #23 and #24).

At state "1", the time of motor warm up is timed by updating the warm up timer (count up) at step #31.

When the update of the motor warm up timer attains a value equivalent to the timer value which indicates the expiration of a predetermined time, a paper feed permission flag is set for making a check whether to start or not the transport of paper sheet P during the paper feed process (steps #32 and #33).

At state "2" a check is made whether the copy mode specified from the operation panel OP is a monocolor mode or a fullcolor mode (step #41). The relevant process according to each copy mode is carried out.

In the following described process, steps #42–#46 of state "2", states "3", "4", "13" to "15" correspond to the monocolor mode. Steps #47–#49 of state "2", and states "5" to "15" correspond to the fullcolor mode.

The process of the monocolor mode will be explained hereinafter.

When monocolor mode is specified, at state "2", the ND filter is set, corona charger 4 and exposure lamp 33 are turned on, scan is requested (setting a scan request flag), and the developing unit (one of developing units 6–9) corresponding to the reproduction color specified by color keys 225–231 is turned on.

The request of scan starts the forward drive of scanner 30 at the scan process to commence latent image formation.

At state "3", corona charger 4 and exposure lamp 33 are turned off at the end of scan of original D. Then, activating developing unit is turned off (steps #51 the #53).

If the image formation discontinue flag is at the reset state, the control proceeds to the process of state "4" (steps #54 and #58).

If the image formation discontinue flag is set, the state to be carried out at the restart by state "15" is set to state "4" from the image formation process discontinued by state "14" described later (step #55).

For holding the toner image already formed on transfer belt 11, an image retaining timer is set to time the time period from the current time point till the end of the primary transfer. Then, the control proceeds to state "14" (steps #56 and #57).

At state "4", a check is made whether there is a subsequent copy request, i.e. whether image formation of the specified number of copies has terminated (step #61).

If the image formation number of sheets has not reached the specified number of sheets, the process generally returns to state "2" to repeat the serial image formation process (steps #62 and #63).

The setting of a stop flag means that image formation was carried out switching the selection of paper sheet cassettes 42 and 43. In this case, the stop flag and the paper feed permission flag are reset to move to the standby state, and control proceeds to state "13" (steps #62, #64–#66).

At state "13", a check is made by the detected state of discharge sensor 88 whether the discharge of the last copy sheet P of the specified number of copies or the paper sheet P specified by the change of the selection of the feeding paper during the copy has ended or not (step #141).

When the discharge has been completed, main motor 24 and PC motor 25 are turned off (step #142) to bring copying apparatus 1 to the standby state. The state is returned to the initial value "0".

If the discharge has not been completed, a check is made of print key 200 which is valid to be ON at the end of the secondary transfer. If print key 200 is turned on, the state is returned to "2" (steps #144 and #145).

The image formation process and the process for discontinue and restart are carried out during states "14" and "15".

That is to say, at state "14", fur brush 190 is withdrawn at the end of the time period of the above described image retain timer. The cleaner state of the cleaning process is specified "9". Then, PC motor 25 is turned off to proceed to the next state "15" (steps #151 –#157).

By the withdraw of fur brush 190, the toner image is retained on transfer belt 11. Transfer belt 11 stops rotating by PC motor 25 being turned off.

At state "15", waiting is conducted for an image discontinue flag to be reset by the image formation restart process to return to the state that is stored as the state of image formation restart (steps #158 and #159).

The fullcolor mode process will be explained hereinafter.

At state "2", B filter is set to carry out color separation exposure corresponding to Y toner (step #47).

To define the time period of the cleaning of transfer belt 11 (preliminary cleaning) that is carried out before image formation, a count value equivalent to preliminary process time period Tf is set for the preliminary process timer. The time period subtracting the currently performed subsequent cleaning time period which is the subsequent process of the prior image formation from the preliminary process defined time period required for cleaning the whole circumference of transfer belt 11 (a time period of more than one rotation of transfer belt 11) is the preliminary process time period Tf (step #48).

At state "5", a flag for the mark detection permission is set at the termination of the preliminary cleaning (steps #71–#73).

By this mark detection permission, the monitoring of belt mark signal S10 is commenced to control the timing of multitransfer at the belt mark detection process. On receiving the scan permission provided by the belt mark detection process, scanning is commenced in synchronism with belt mark signal S10 during the scan process.

AT state "6", developing unit 6 is turned on to correspond to the timing of the commence of the scanning (steps #75 and #76).

At state "7", waiting is conducted for the termination of scanning to turn off exposure lamp 33 and corona charger 4. Then, developing unit 6 is turned off to set G filter for the next exposure (steps #81–#84).

A check is made of the image formation discontinue flag. If this flag is set, the mark detection permission plug is reset to specify the state of image formation restart as "8". The image retain timer is set to proceed to the process of state "14" similar to that of the monocolor mode (steps #85–#89).

At states "8" and "9", and states "10" and "11", the series of process for carrying out image formation of each toner image of M and C, that is to say, turning on the corresponding developing units of 7 and 8, turning off exposure lamp 33 and corona charger 4 at the termination of the scan, storing the state of image formation restart when an image formation discontinue flag is set, setting the image retaining timer, etc. are carried out, similar to the case of states "6" and "7".

At state "12", a check is made whether there is a subsequent copy request or not. If not, the paper feed permission flag and mark detection permission flag are reset to proceed to the aforementioned state "13" to carry out the process for image formation termination (steps #131–#134).

If there is a subsequent copy request, B filter is normally set to return to state "6". Then, image formation of each toner image of Y, M and C are repeated (steps #135–#137).

If a stop flag is set, copying apparatus 1 must be brought to the standby state as in the case of the monocolor mode. Therefore, the stop flag, the paper feed permission flag, and the mark detection permission flag are reset to return to state "13" (steps #135, #138, #132–#134).

Figure 6A:
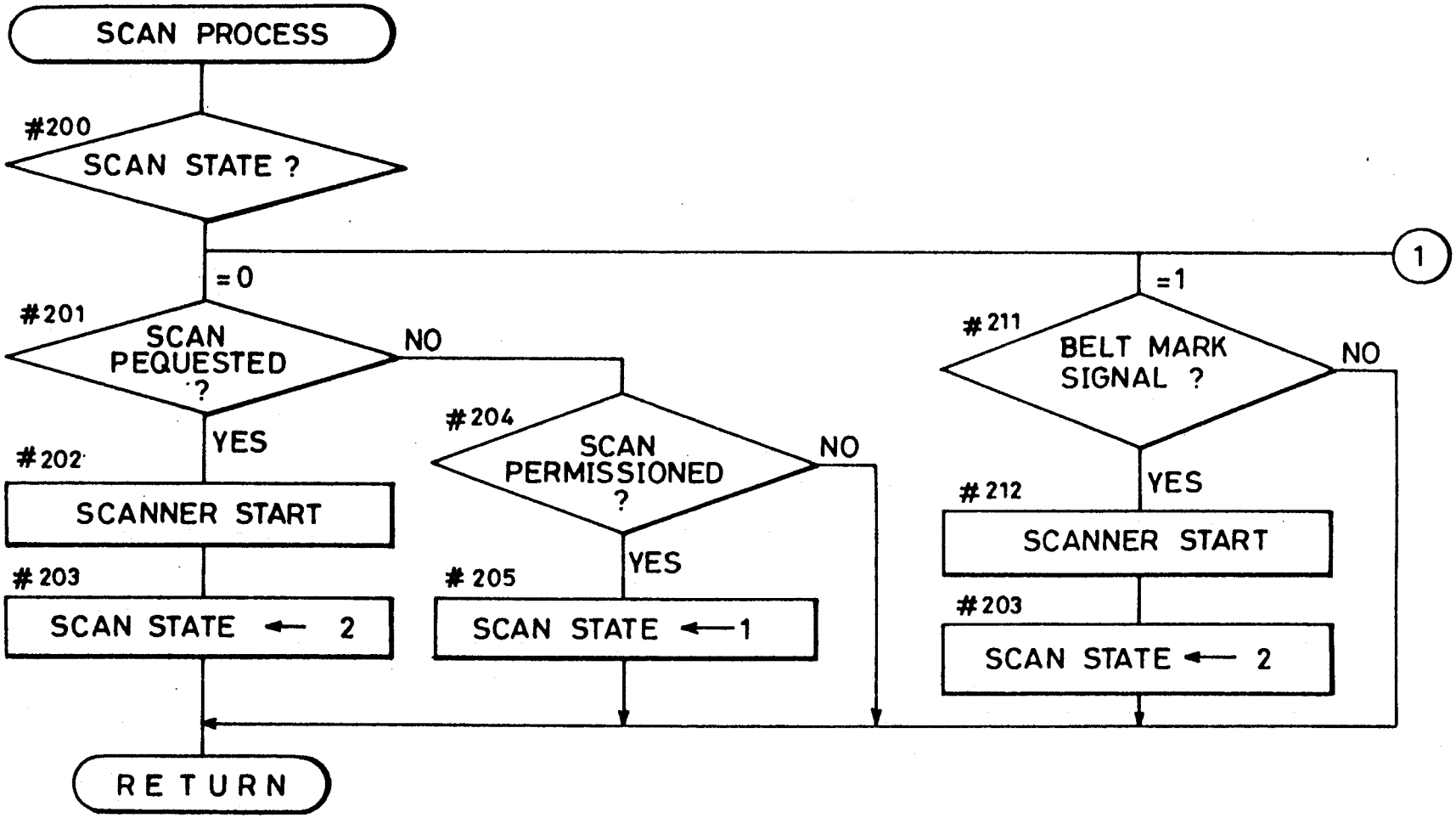
FIGS. 6A and 6B are flow charts specifically showing the content of the scan process of FIG. 4.
Figure 6B:
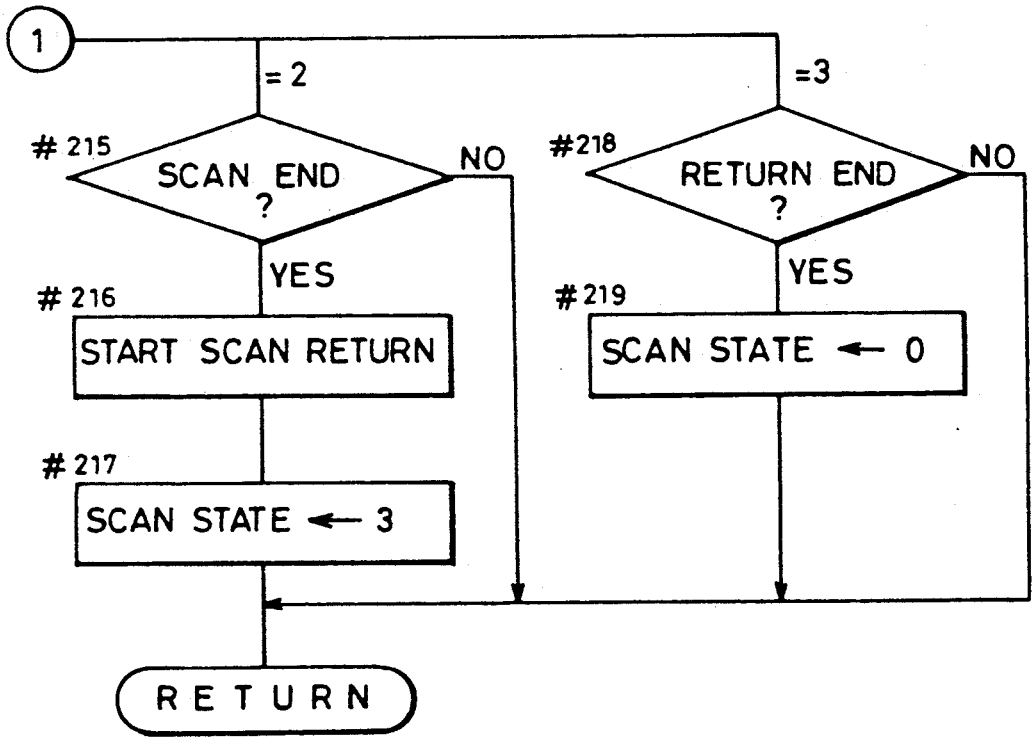

FIGS. 6A–6B are flow charts of the scan process of FIG. 4.

First, a check is made of the scan state (step #200). The following process are carried out according to each state.

At state "0", a check is made whether a scan is requested by the scan request flag (step #201). The scan request flag is set at the monocolor mode during image process, as mentioned above.

If there is a scan request, the forward drive of scanner 30 is immediately commenced via scan motor controller 404 (step #202). The process proceeds to state "2" (step #203).

If there is not a scan request, a check is made whether scanning is permitted or not by the scan permission flag (step #204). The scan permission flag is set during the belt mark detection process at the fullcolor mode.

If there is a scan permission, the process proceeds to state "1" (step #205).

At state "1", the forward drive of scanner 30 is commenced at the output timing of belt mark signal S10 (step #212).

At state "2", a check is made whether scanner 30 of the forward drive reaches the trailing edge of original D (step #215).

If this scanning has terminated, scanner 30 immediately commences the return drive (#216).

At state "3", the state is returned to the initial value of "0" at the termination of the return of scanner 30.

FIGS. 7A–7E are flow charts of the belt mark detection process of FIG. 4.

First, a check is made of the mark state at step #300. The following process are carried out according to each state.

At state "0", the copy mode is checked when print key 20 is turned on. If the fullcolor mode is specified, the process proceeds to the next state (step #301–#303).

At state "1", waiting is conducted for the mark detection permission flag to be set at the image formation process (step #311).

When the mark detection permission flag is set, a check is made whether scanning is possible or not at every generation of belt mark signal S10 by referring to a scan table TS (described afterwards) relating to the paper sheet size or the original size and copy magnification (step #312).

If scanning is possible for every generation of belt mark signal S10, the process proceeds to step #314 to update the state to "2".

If scanning is impossible for every generation of belt mark signal S10, a skip flag is set to invalidate belt mark signal S0 regarding scanning for every generation (step #313). Then, the state is updated.

In copying apparatus 1, the circumference of transfer belt 11 is 450 mm, and the system speed of the normal copy mode is 110 mm/sec.

Therefore, one rotation time period of transfer belt 11 (the generation period of one belt mark signal) is 4.09 seconds.

The time period required for the forward and backward drive of scanner 30 comprising acceleration, constant speed, and deceleration time period depends upon paper sheet P or the size and the copy magnification of original D.

For example, in the case of equal-scale magnification of an original D of A4 size the longitudinal length of which is set in a direction perpendicular to the scanning direction, the forward and backward drive time period is 3.0 seconds (forward drive=2.2 seconds, backward drive=0.8 seconds). Because this drive time period is shorter than the generation time period of belt mark signal S10, scan can be commenced continuously for every generation of belt mark signal S10 (for every one rotation of the transfer belt).

In the case of equal-scale magnification of an original D of A3 size the longitudinal length of which is set in the scanning direction, the forward and backward drive time period of scanner 30 is 5.4 seconds (forward drive=4.2 seconds, backward drive =1.2 seconds). Because this time period is longer than the generation time period of belt mark signal S10, scanning cannot be commenced continuously for every generation of belt mark signal S10. In this case, belt mark signal S10 is made invalid for every other generation, as described before, whereby scanning is commenced for every generation of two belt mark signals S10.

Figure 7A:
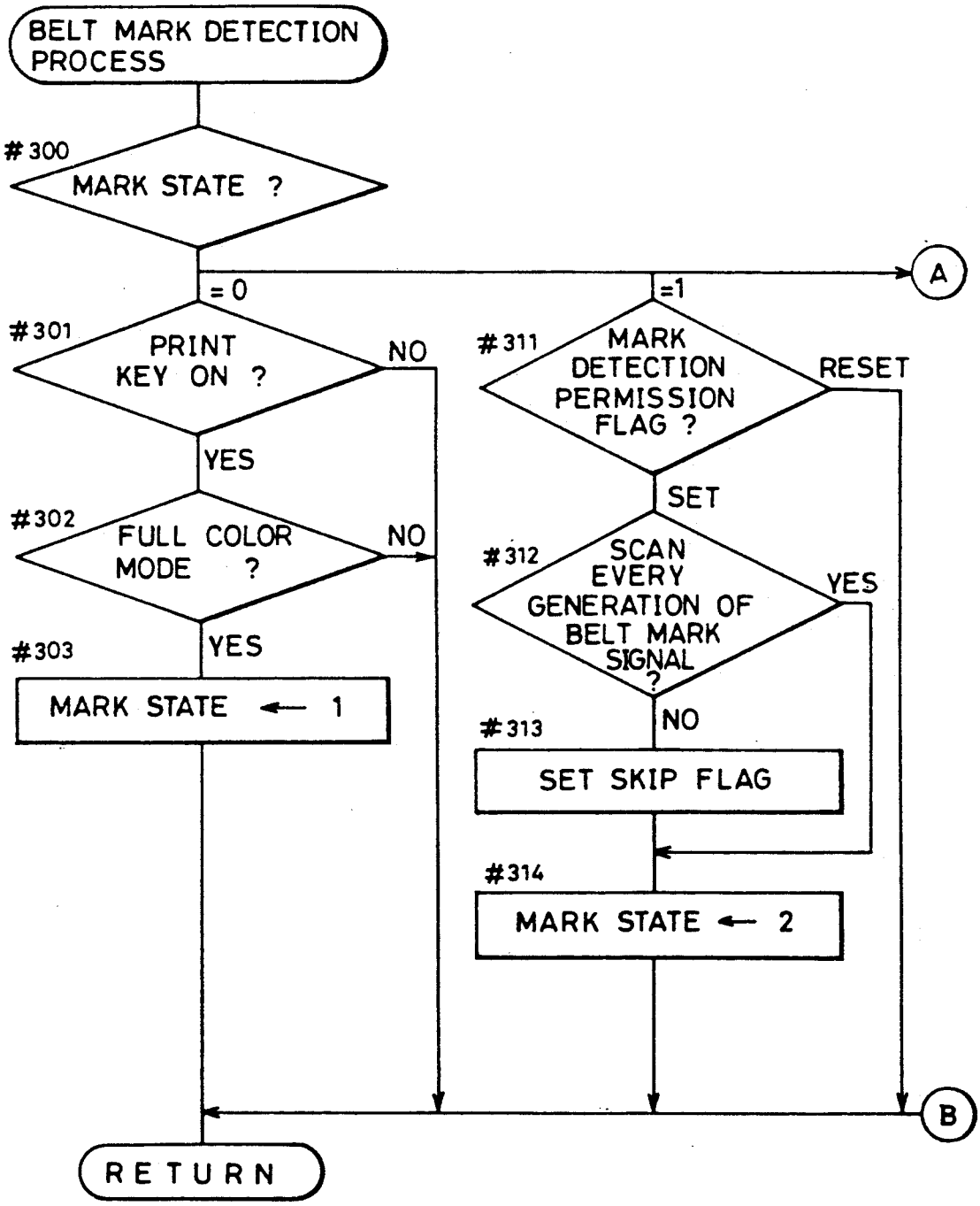
FIGS. 7A–7E are flow charts specifically showing the content of the belt mark detecting process of FIG. 4.
Figure 7B:
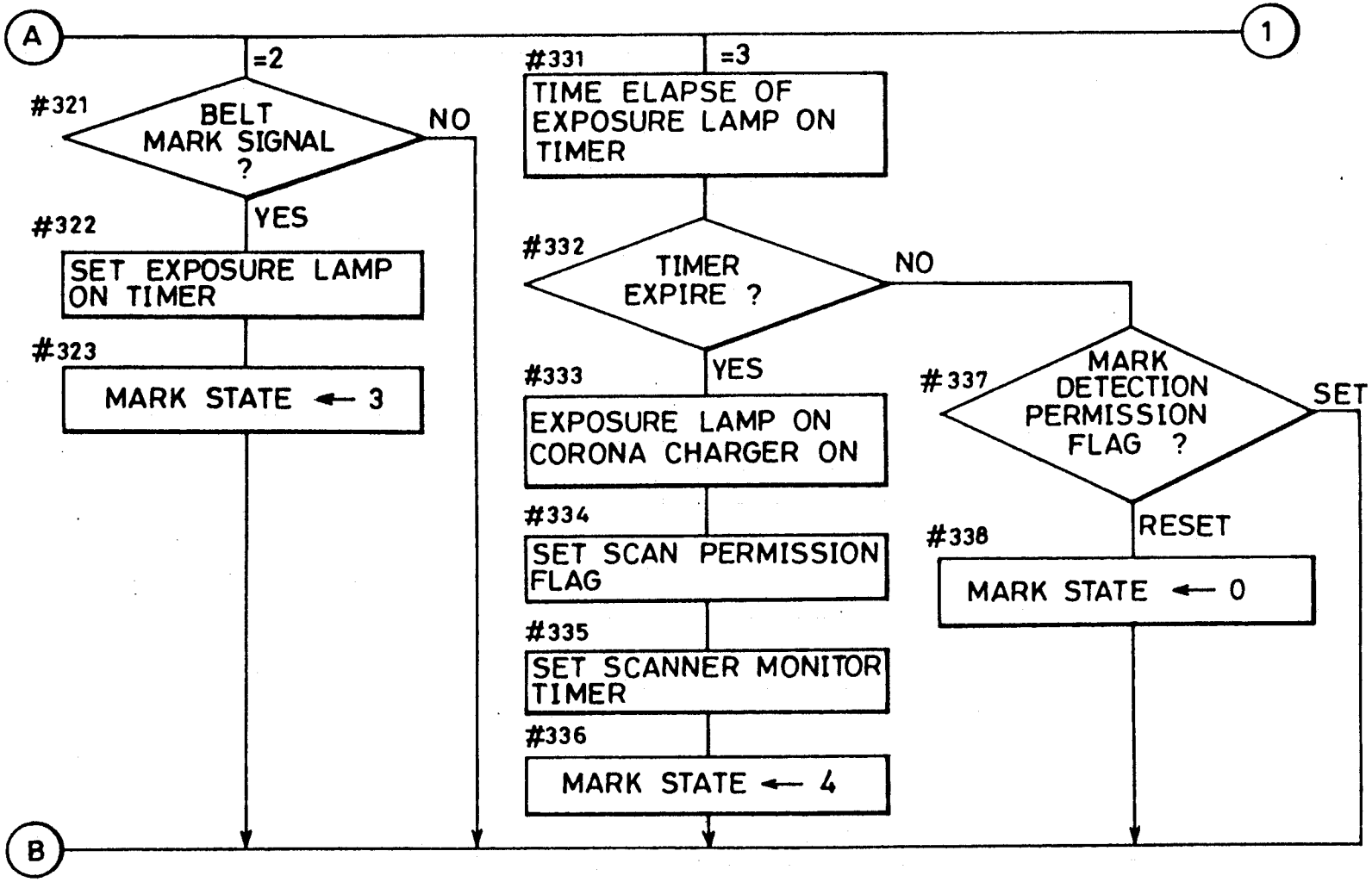
Figure 7C:
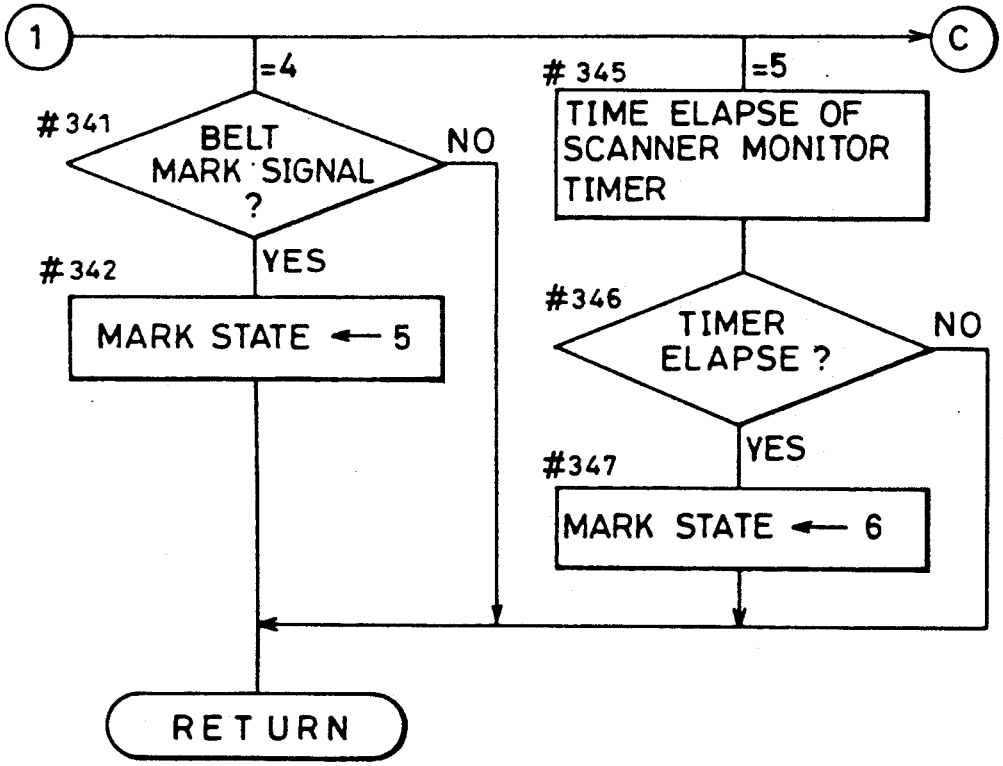
Figure 7D:
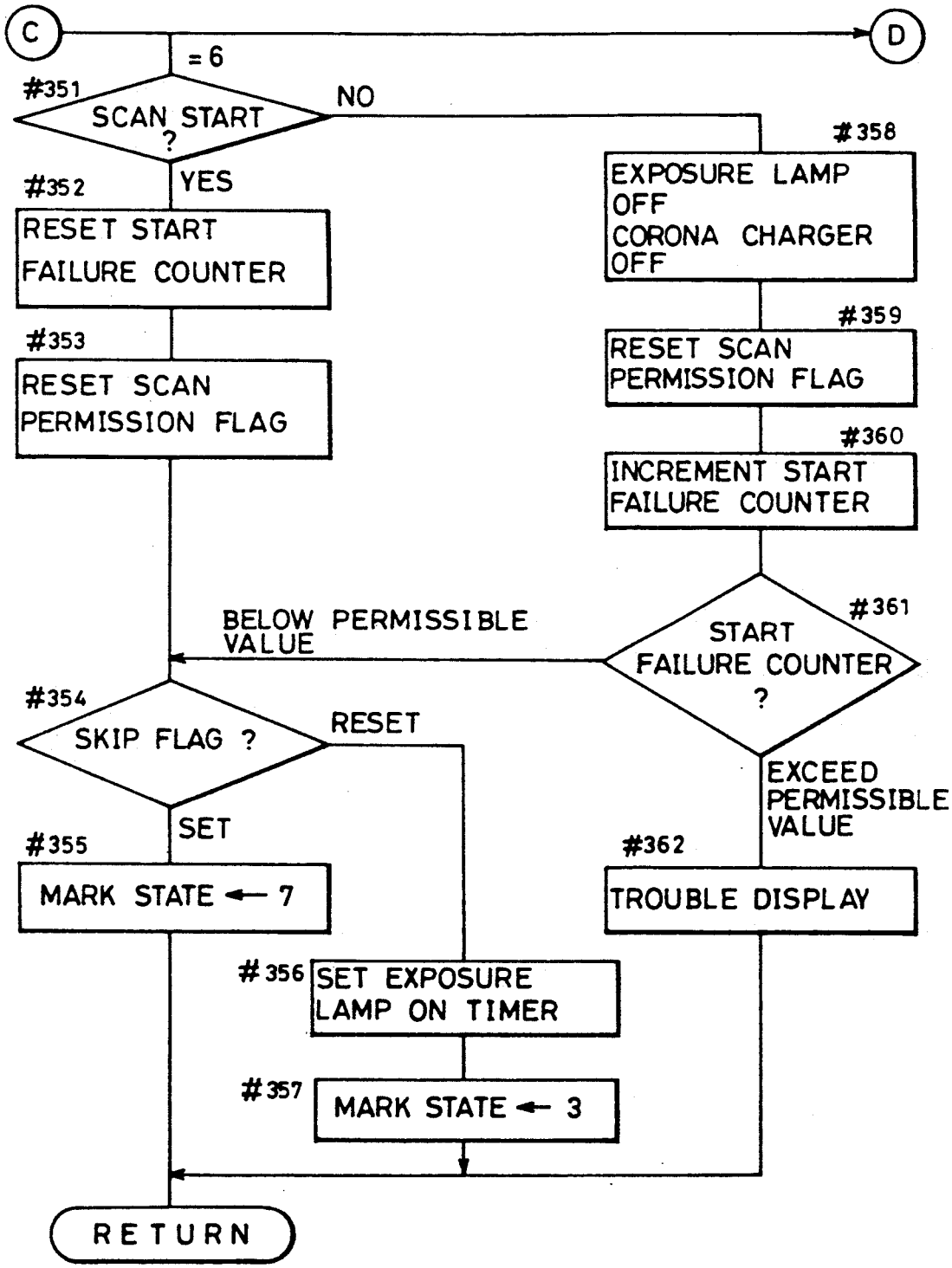
Figure 7E:
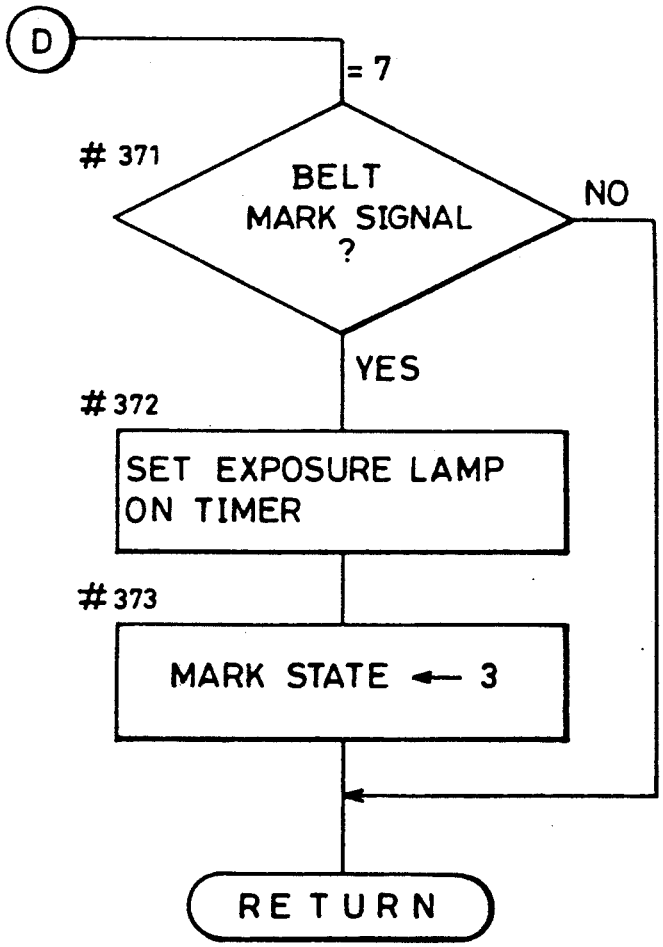
Figure 8A:
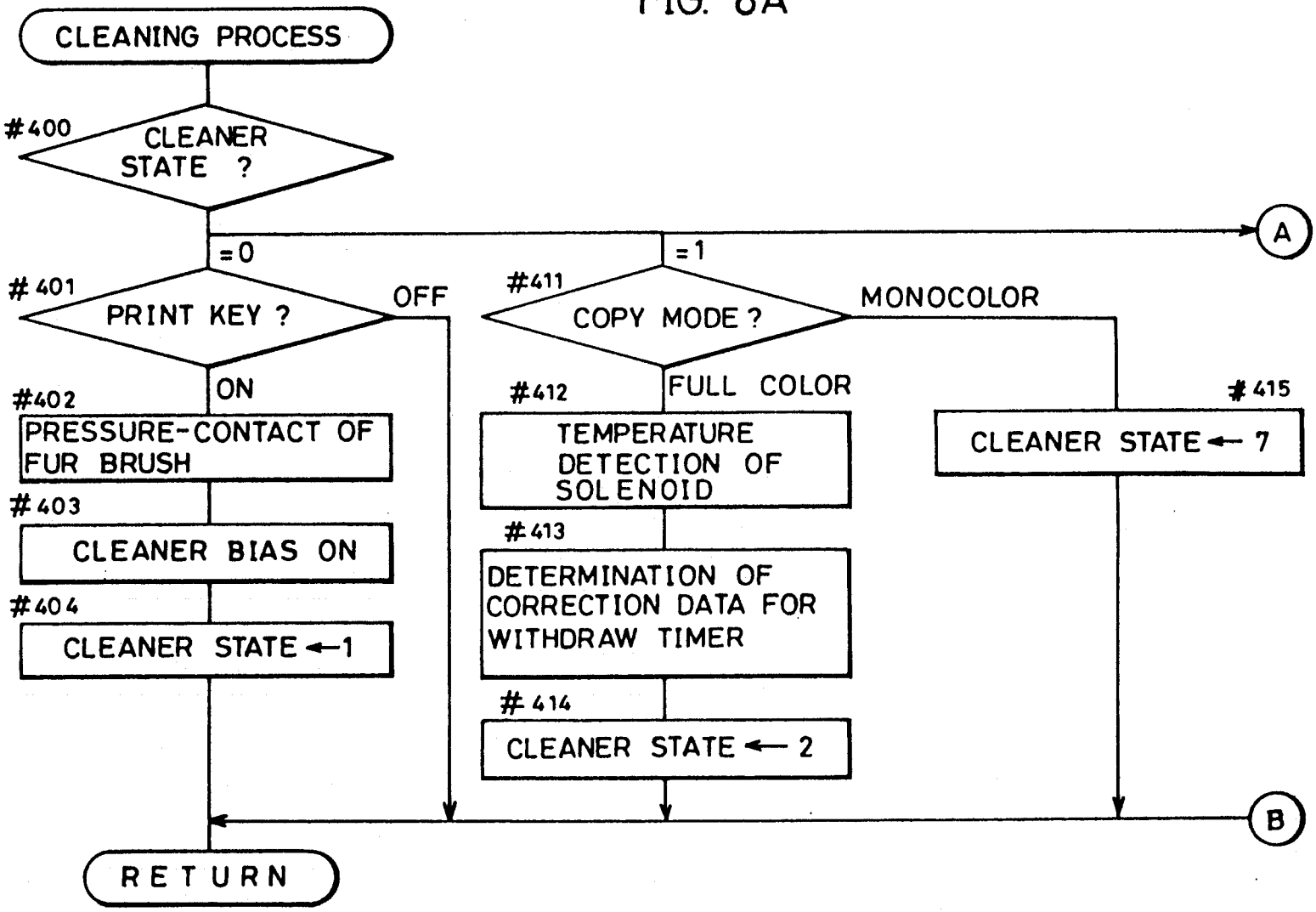
FIGS. 8A–8G are flow charts showing specifically the content of the cleaning process of FIG. 4.
Figure 8B:
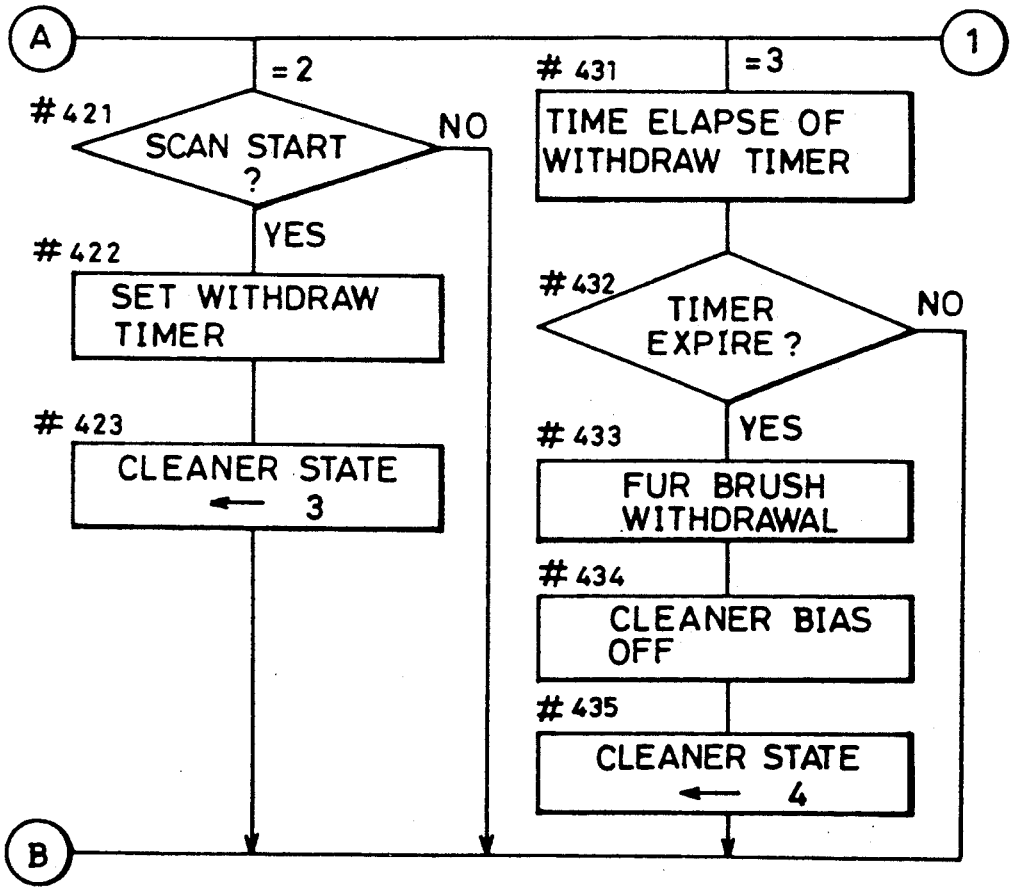
Figure 8C:
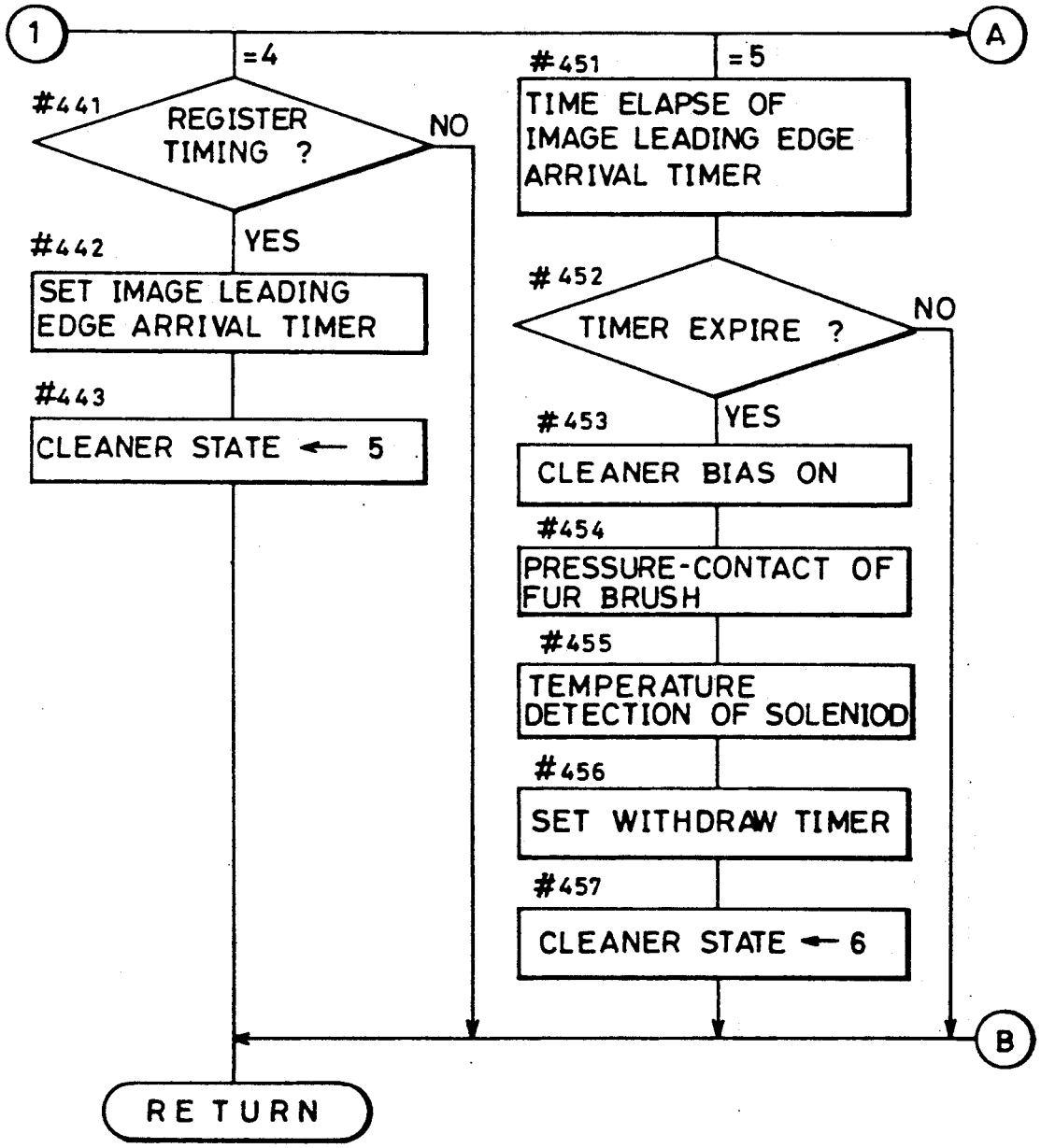
Figure 8D:
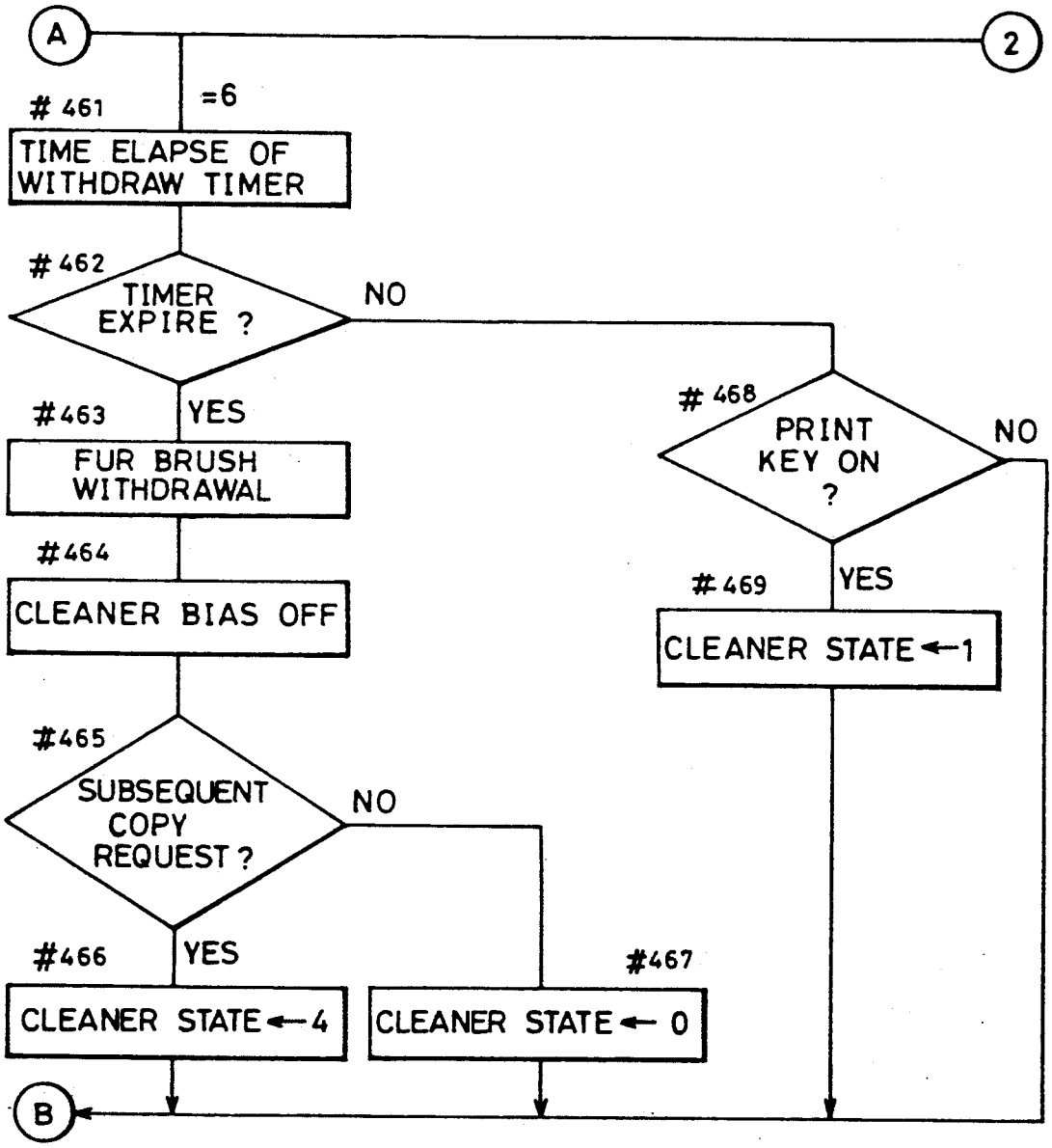
Figure 8E:
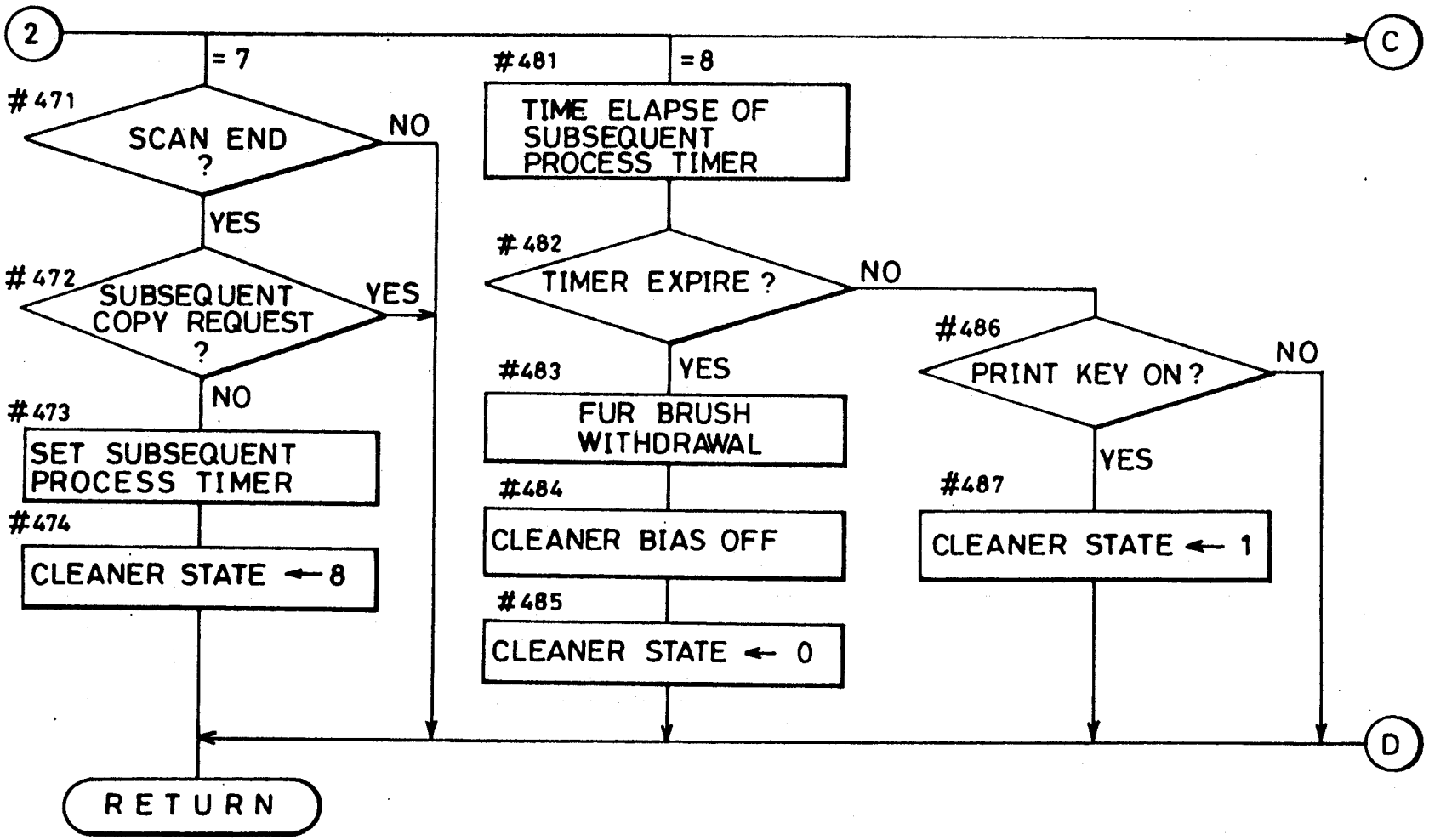
Figure 8F:
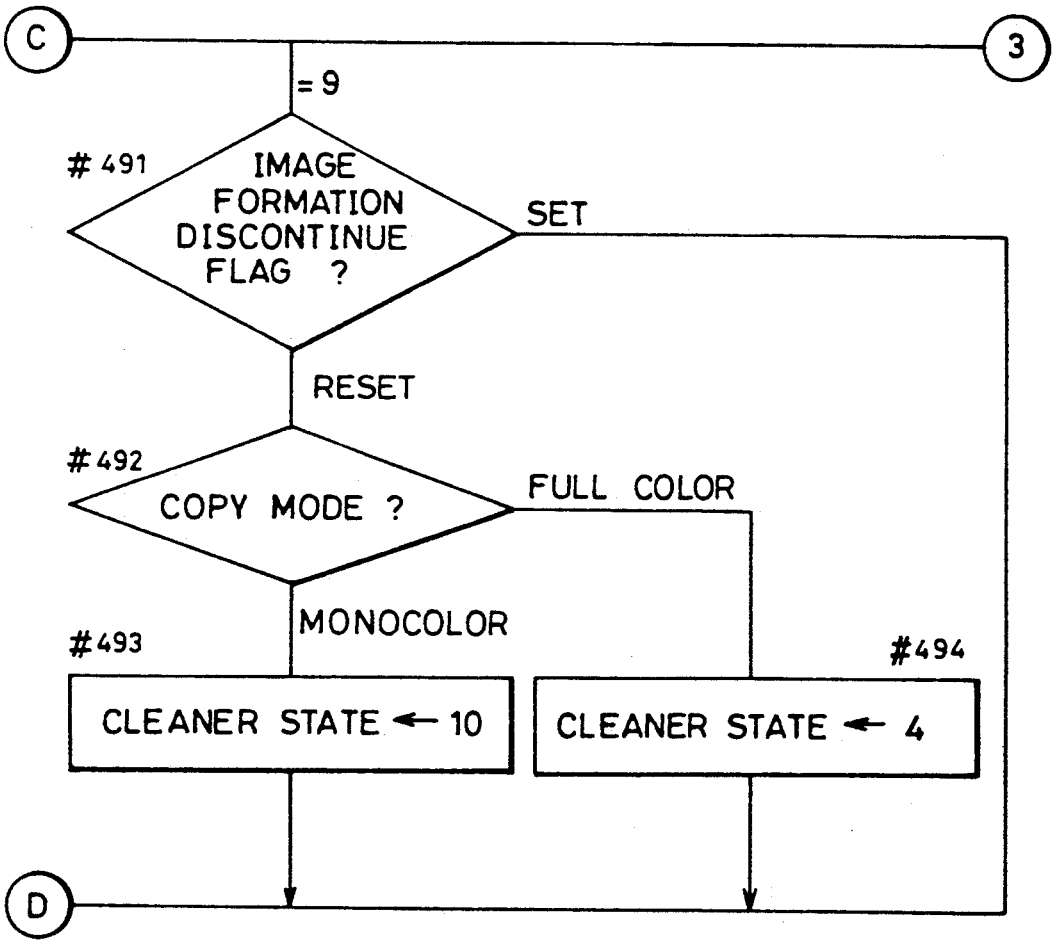
Figure 8G:
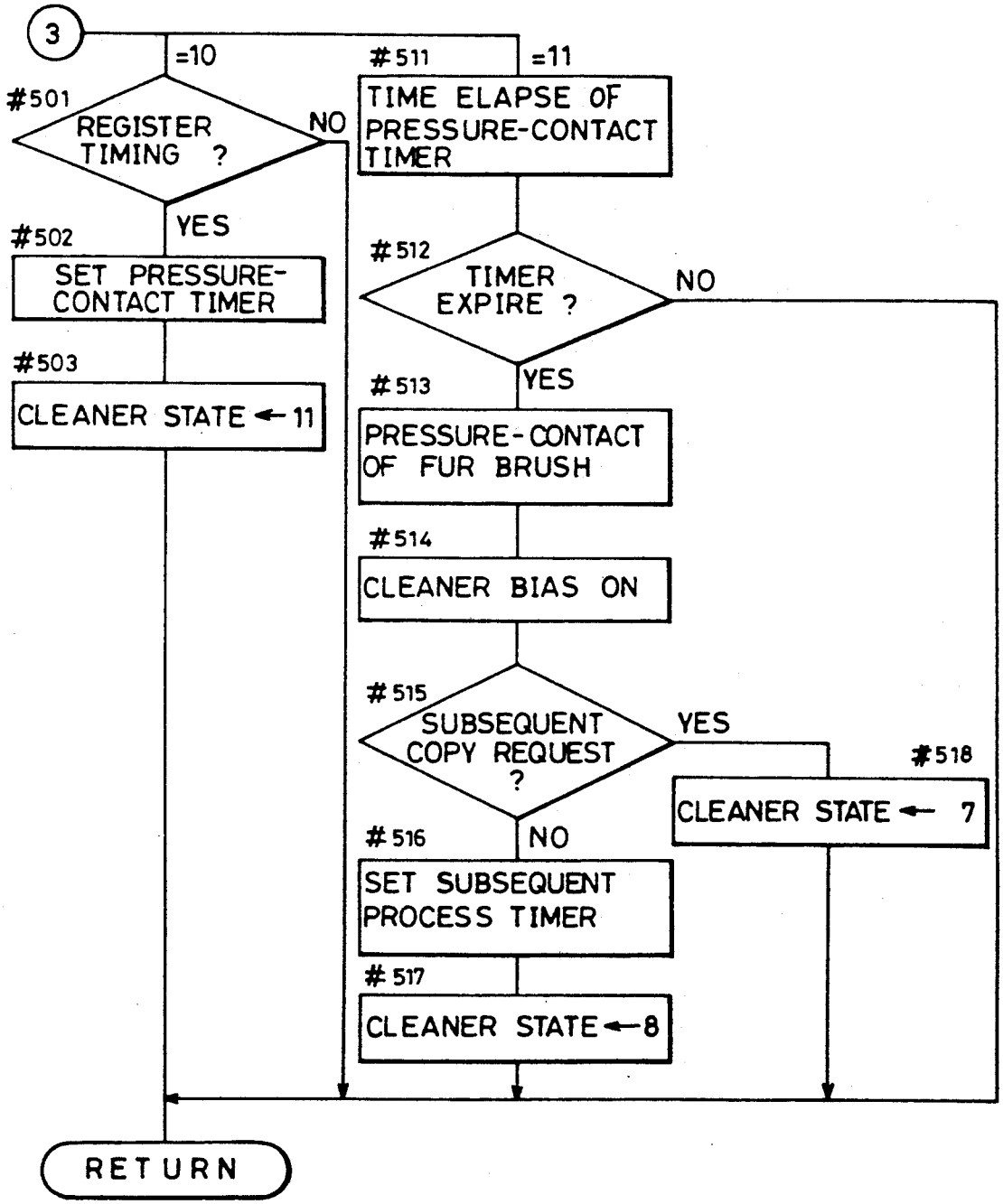

Referring to FIG. 7B, at state "2", belt mark signal S10 is checked (step #321).

If belt mark signal S10 is on (is generated), an "exposure lamp on" timer is set for determining the illumination timing of exposure lamp 33 (step #322). The state is updated to "3" (step #323).

Transfer belt 11 is rotated at a constant speed (system speed), so that the generation time period of belt mark signal S10 is constant. Copying apparatus 1 has the scanning started based on belt mark signal S10. For obtaining a stabilized light amount of exposure lamp 33, the "exposure lamp on" timer is provided for turning on the light of exposure lamp 33 after a time period from the generation timing of one belt mark signal S10 prior to scanning.

This prevents wasteful lightening of exposure lamp 33, and also avoids scanning under an unstabilized light amount.

At state "3", waiting is conducted for the expiration of the "exposure lamp on" timer (steps #331 and #332).

The mark detection permission flag is checked again during the time elapse of the "exposure lamp on" timer (step #337). If the mark detection permission flag is reset during the image formation process, the state is returned to "0" to bring copying apparatus 1 to the standby state.

On the expiration of the "exposure lamp on" timer, exposure lamp 33 and corona charger 4 are turned on to prepare for scanning (step #333). Then, the scan permission flag is set which will be checked during the above-described scan process (step #334).

A scan monitor timer is set for checking the start timing of the scan (step #335). The state is updated to "4".

At state "4", waiting is conducted for belt mark signal S10 to be on (step #341) to update the state to "5".

At state "5", the time of the scan monitor timer elapses (step #345). A check is made of the termination (step #346). When a predetermined time period elapses from the ON of belt mark signal S10 and the scan monitor timer expires, the state is specified "6".

At state "6", first a check is made whether the scanning has commenced or not by the scan process.

When scanning has been initiated, a start failure counter which indicates the number of times the scanning was not commenced at the proper timing and a scan permission flag are reset (steps #352 and #353).

Then, a check is made of the skip flag (step #354).

If the skip flag is reset, the scan may be commenced for every generation of the belt mark signal S10. Therefore, the "exposure lamp on" timer is immediately set (step #356) to return the state to "3" for the next scan.

When the skip flag is set, scanning may be commenced for every two generations of belt mark signal S10. In this case, the state is updated to "7" (step #355), whereby the "exposure lamp on" timer is set at the ON of belt mark signal S10 (step #372). The state is returned to "3".

If the answer is no at step #351, i.e. if scanning is not commenced by some reason even though the scanning start timing has been obtained, exposure lamp 33 and corona charger 4 are turned off (step #358) and the scan permission flag is reset (step #359). Then, the start failure counter is incremented (step #360).

Next, a check is made of the value of the start failure counter (step #361).

If the value of the start failure counter is less than a predetermined permissible value, the process proceeds to step #354 to try for the restart of scanning.

If the value of the start failure counter exceeds a predetermined permissible value, determination is made that the cause preventing the start of scanning is not accidental and natural recovery is not possible. The trouble display LED224*d* of operation panel OP is illuminated to notify the occurrence of a trouble to the operator (#362).

FIGS. 8A–8G are flow charts of the cleaning process of FIG. 4.

First, a check is made of the cleaner state (step #400). The following process are carried out according to each state.

At state "0", fur brush 190 is pressure-contacted and cleaner bias HV turned ON upon the ON of print key 200. The cleaning of transfer belt 11 is initiated (steps #401-#403).

At state "1", the copy mode is first checked (step #411).

When the copy mode is the monocolor mode, the control proceeds to state "7" (step #415).

If the copy mode is the fullcolor mode, the time period of the preliminary cleaning of transfer belt 11 must be corrected. The temperature of solenoid 195 of belt cleaner 19 is detected, whereby the correction value for the timer value of the withdraw timer is determined for defining the withdraw timing of fur brush 190 according to the detected temperature. The process proceeds to state "2" (steps #412-#414).

At state "2", when the scanning is commenced, the correction value determined at step #413 is added to a predetermined standard value, whereby this summed value is set as the timer value of the withdraw timer. The process proceeds to state "3" (steps #421-#423).

At state "3", fur brush 190 is withdrawn and cleaner bias HV turned off on the expiration of the withdraw timer. This completes the preliminary cleaning (steps #431-#435).

At state "4", when timing roller 46 is ON at the register timing, an image leading edge arrival timer is set (step #441-#443). The image trailing edge arrival timer times the time period for the portion corresponding to the leading edge of the toner image on transfer belt 11 to rotatably move from the secondary transfer to the disposed position of belt cleaner 19.

At state "5", cleaner bias HV is ON and fur brush 190 pressure-contacted for commencing the subsequent cleaning of transfer belt 11 upon the expiration of the image leading edge arrival timer (steps #451-#454).

To correct the time period of the subsequent cleaning of transfer belt 11, the temperature of solenoid 195 of belt cleaner 19 is detected to set the withdraw timer to a timer value corrected according to the detected result (step #455 and #456).

At state "6" on expiration of the withdraw timer, fur brush 190 is withdrawn and cleaner bias HV turned off (steps #461-#464).

If there is not a subsequent copy request, the state is returned to "0" to proceed to the standby state. If there is a subsequent copy request, the process proceeds to state "4" (steps #465-#467).

If print key 200 is turned on during the time elapse of the withdraw timer, i.e. during the subsequent cleaning, the process returns to state "1" (steps #468 and #469).

The process for subsequent cleaning of the monocolor mode are carried at states "7" and "8".

At state "7" on the termination of the scanning, a check is made whether there is a subsequent copy request. If subsequent copy is not requested, the subsequent process timer is set (steps #471-#473). The subsequent process timer times one rotation time period of transfer belt 11. When there is a subsequent copy request, no process is carried out because fur brush 190 should be left at the pressure-contact state.

At state "8", waiting is conducted for the expiration of the subsequent process timer. Fur brush 190 is withdrawn and cleaner bias HV turned off. The state is returned to the initial value "0" (steps #481-#485).

If print key 200 is turned on during the time elapse of the subsequent process timer, the state is returned to "1" (steps #486 and #487).

States "9" to "11" are carried out when image formation is discontinued.

At state "9", waiting is conducted for the image formation discontinue flag to be reset (step #491).

Until the image formation discontinue flag is reset, the withdraw state of fur brush 190 by image formation state "14" of the image formation process is retained. In other words, cleaning of transfer belt 11 is inhibited, whereby the toner image on transfer belt 11 is maintained.

When the image formation discontinue flag is reset, the copy mode is checked. In the case of fullcolor mode, the control returns to state "4". In the case of monocolor mode, the control proceeds to state "10" (steps #492-#494).

At state "10", the pressure-contact timer is set at a register timing to proceed to state "11" (steps #501-#503). The pressure-contact timer is equivalent to the image leading edge arrival timer used at the fullcolor mode. The pressure-contact timer times the time period for the portion on transfer belt 11 corresponding to the leading edge of the toner image to rotatably move from the secondary transfer position to the disposed position of belt cleaner 19.

At the state "11", after the expiration of the pressure-contact timer, fur brush 190 is pressure-contacted and cleaner bias HV turned on (steps #511 -#514).

If there is a subsequent copy request, the state returns to "7". When subsequent copy is not requested, the preliminary process timer is set to return to state "8" (steps #515-#518).

Although not indicated in the flow charts, when composite monocolor mode for forming a composite monocolor copy image is selected, multitransfer of a toner image of two colors are carried out according to scanning based on belt mark signal S10, as described before.

Regarding the process carried out by CPU401 of the above described embodiment, steps #412 and 413 of the the drive timing correction means that is the component structure of the present invention.

According to the above described embodiment, a preliminary cleaning of a time period of one rotation of transfer belt 11 is carried out in the case of fullcolor mode. In the case of monocolor mode, a particular preliminary cleaning time period is not provided. Fur brush 190 is pressure-contacted at the time of the ON of print key 200 to carry out the cleaning of transfer belt 11 in parallel with the image formation.

In the case of fullcolor mode, the subsequent cleaning is carried out for one rotation time period of transfer belt 11 (the set time period of the withdraw timer) according to the register timing for the last paper sheet P. In the case of monocolor mode, the subsequent cleaning is carried out for a time period shorter than one rotation time period of transfer belt 11 (the set time period of the subsequent process timer) according to the termination timing of scanning of the last paper sheet P.

The starting time and the time period for cleaning transfer belt 11 is optimized according to the copy mode, so that wasteful operation and unnecessary waiting time encountered in the case of standardized cleaning irrespective of the copy mode can be eliminated.

The above described embodiment is implemented so that belt cleaner 19 moves to the activating position when solenoid 195 is turned off, that is to say, solenoid 195 is turned off during cleaning. Therefore, even if the monocolor mode which carries out cleaning of transfer belt 11 during image formation is frequently selected, overheating of solenoid 195 can be prevented and the lifetime thereof expanded because the time period of solenoid 195 turned on is reduced.

Various modifications of the contents and order of the flow chart, and the structure, shape, material, position and numbers of each component of copying apparatus 1 including the accommodating means of paper sheet P are allowed in the above described embodiment.

According to the present invention, deterioration of the copy image due to deviation of the termination timing of cleaning of the toner image holding medium can be prevented.

Although the present invention has been described and illustrated in detail, it is clearly understood that the same is by way of illustration and example only and is not to be taken by way of limitation, the spirit and scope of the present invention being limited only by the terms of. the appended claims.

What is claimed is:

1. An image forming apparatus comprising:

a photoreceptor, image forming means for forming a toner image on said photoreceptor, an intermediate transfer medium for receiving the toner image formed on said photoreceptor, transferring means for transferring the toner image on said intermediate transfer medium to a sheet, cleaning means for removing toner from said intermediate transfer medium, signal output means for providing an image formation start signal for starting the image formation operation of said image forming means, first control means responsive to said provided image formation start signal for carrying out a preliminary cleaning of a predetermined time period and for starting image formation by said image forming means when said preliminary cleaning is terminated, second control means for carrying out a subsequent cleaning of a predetermined time period after the termination of said transfer process by said transferring means, and third control means for starting image formation by said image forming means after the termination of the subsequent cleaning of a predetermined time period when an image formation start signal is provided by said signal output means during said subsequent cleaning.

2. The image forming apparatus according to claim 1, wherein said intermediate transfer medium holds a plurality of toner images subsequently in superimposition.

3. An image forming apparatus comprising:

a photoreceptor, image forming means for forming a toner image on said photoreceptor, an intermediate transfer medium for receiving the toner image formed on said photoreceptor, transferring means for transferring the toner image on said intermediate transfer medium to a sheet, cleaning means for removing toner from said intermediate transfer medium, signal output means for providing an image formation start signal for starting the image formation operation of said image forming means, first control means responsive to said provided image formation start signal for carrying out a preliminary cleaning of a predetermined time period and for starting image formation by said image forming means when said preliminary cleaning is terminated, second control means for carrying out a subsequent cleaning of a predetermined time period after the termination of said transfer process by said transferring means, and third control means for canceling cleaning of said second control means and for reducing the time period of the preliminary cleaning by said first control means, when an image formation start signal is provided by said signal output means during said subsequent cleaning,.

4. The image forming apparatus according to claim 3, wherein said third control means determines a time period for reducing said preliminary cleaning based on the output timing of an image formation start signal.

5. The image forming apparatus according to claim 4, wherein the time period reduced by said third control means is equivalent to the time period of said subsequent cleaning carried out by said second control means.

6. The image forming apparatus according to claim 5, wherein said intermediate transfer medium holds a plurality of toner images subsequently in superimposition.

7. An image forming apparatus comprising:

a photoreceptor image forming means for forming a toner image on said photoreceptor, an intermediate transfer medium for receiving the toner image formed on said photoreceptor, transferring means for transferring the toner image on said intermediate transfer medium to a sheet, cleaning means for removing toner from said intermediate transfer medium, signal output means for providing an image formation start signal for starting the image formation operation of said image forming means, first control means for cleaning the entire area of said intermediate transfer medium when the transfer process by said transferring means is terminated, and second control means for starting image formation by said image forming means after continuing the cleaning of a not-yet cleaned area of said intermediate transfer medium, when an image formation start signal is provided by said signal output means during the cleaning by said first control means.

8. The image forming apparatus according to claim 7, wherein said intermediate transfer medium holds a plurality of toner images subsequently in superimposition.

9. An image forming apparatus comprising:

a photoreceptor, image forming means for forming a toner image on said photoreceptor, an intermediate transfer medium for receiving the toner image formed on said photoreceptor, transferring means for transferring the toner image on said intermediate transfer medium to a sheet, cleaning means for removing toner from said intermediate transfer medium, means for providing an image formation start signal for starting the image formation operation of said image forming means, first control means responsive to said provided image formation start signal for cleaning the entire area of said intermediate transfer medium by said cleaning means and for starting image formation by said image forming means after the cleaning is terminated, second control means for cleaning the entire area of said intermediate transfer medium, after the termination of said transfer process by said transferring means, and third control means for starting image formation by said image forming means after continuing the cleaning of the not-yet cleaned area of said intermediate transfer medium, when an image formation start signal is provided by said signal output means during cleaning by said second control means.

10. The copying image apparatus according to claim 9, wherein said intermediate transfer medium holds a plurality of toner images subsequently in superimposition.

* * * * *

UNITED STATES PATENT AND TRADEMARK OFFICE

CERTIFICATE OF CORRECTION

PATENT NO. : 5,173,735

DATED : December 22, 1992

INVENTOR(S) : Keiji Kusumoto

It is certified that error appears in the above-identified patent and that said Letters Patent is hereby corrected as shown below:

On the title page, change the spelling of the first name of the inventor from "Kenji" to --Keiji--.

In Col. 3, line 58, delete "10".

In Col. 10, lines 50 and 51, change "steps #51 the #53" to --steps #51-#53--.

In Col. 13, line 18, change "S0" to --S10--.

UNITED STATES PATENT AND TRADEMARK OFFICE

CERTIFICATE OF CORRECTION

PATENT NO. : 5,173,735

DATED : December 22, 1992

INVENTOR(S) : Keiji Kusumoto

It is certified that error appears in the above-identified patent and that said Letters Patent is hereby corrected as shown below:

In Col. 16, line 37, after "the", insert --cleaning process, and steps #455 and #456 correspond to--.

In Col. 18, line 26 (Claim 7, line 2), after "photoreceptor", insert --,-- (comma).

In Col. 18, line 62 (Claim 9, line 11), before "means", insert --signal output--.

Signed and Sealed this

Twenty-sixth Day of October, 1993

*Attest:*

*Attesting Officer*

Bruce Lehman

BRUCE LEHMAN

*Commissioner of Patents and Trademarks*